US011104018B2

(12) United States Patent
Dryfhout

(10) Patent No.: US 11,104,018 B2
(45) Date of Patent: Aug. 31, 2021

(54) SAFETY RAZOR WITH COMB AND BLADE

(71) Applicant: Dryfhout Properties, LLC, Chicago, IL (US)

(72) Inventor: Matthew James Dryfhout, Homer Glen, IL (US)

(73) Assignee: Dryfhout Properties, LLC, Chicago, IL (US)

( * ) Notice: Subject to any disclaimer, the term of this patent is extended or adjusted under 35 U.S.C. 154(b) by 70 days.

(21) Appl. No.: 16/195,487

(22) Filed: Nov. 19, 2018

(65) Prior Publication Data

US 2019/0084168 A1 Mar. 21, 2019

Related U.S. Application Data

(60) Division of application No. 15/156,850, filed on May 17, 2016, now Pat. No. 10,131,062, which is a (Continued)

(51) Int. Cl.
*B26B 21/12* (2006.01)
*B26B 21/40* (2006.01)
*B26B 21/52* (2006.01)

(52) U.S. Cl.
CPC ..... *B26B 21/12* (2013.01); *B26B 21/125* (2013.01); *B26B 21/4031* (2013.01); *B26B 21/4081* (2013.01); *B26B 21/523* (2013.01)

(58) Field of Classification Search
CPC ..... B26B 21/12; B26B 21/125; B26B 21/16; B26B 21/4018; B26B 21/4025;
(Continued)

(56) References Cited

U.S. PATENT DOCUMENTS 65,130 A 5/1867 Spblman
775,134 A 11/1904 Gillette
(Continued)

FOREIGN PATENT DOCUMENTS

CA 2936645 A1 8/2015
CN 2329495 Y 7/1999
(Continued)

OTHER PUBLICATIONS

International Search Report dated Sep. 12, 2017 in PCT/ US2017/ 032949.
(Continued)

*Primary Examiner* — Jason Daniel Prone
(74) *Attorney, Agent, or Firm* — Patents and Licensing LLC; Daniel W Juffernbruch

(57) ABSTRACT

A safety razor removes hair from skin using the cutting blade comprising a sharp edge along an elongated side of a planar surface. An outer comb has a row of outer teeth running along the planar surface on an outside of the cutting blade, each outer tooth is substantially perpendicular to the sharp edge and spaced with a gap between the row of the outer teeth and the planar surface of the cutting blade. Ends of the row of outer teeth comprise outer teeth tips. An inner guard runs along the planar surface on an inside of the cutting blade. The sharp edge of cutting blade is recessed up to a skin surface contour, the skin surface contour defined by the outer teeth tips and an edge of the inner guard. The sharp edge of cutting blade longitudinally bends to cause further recess relative to the skin surface contour.

28 Claims, 17 Drawing Sheets

Related U.S. Application Data continuation-in-part of application No. 14/170,269, filed on Jan. 31, 2014, now Pat. No. 9,718,200.

(58) Field of Classification Search

CPC ... B26B 21/4031; B26B 21/52; B26B 21/523; B26B 21/22; B26B 21/227

USPC ..... 30/30, 31, 47–84, 526, 532, 534; D28/52; 132/213.1

See application file for complete search history.

(56) References Cited

U.S. PATENT DOCUMENTS 913,005 A 2/1909 Lancellotte
974,083 A 10/1910 Likewise
991,147 A 5/1911 Gillette
1,047,617 A 12/1912 Cress
1,060,245 A 4/1913 Gaisman
1,111,721 A 9/1914 Gillette
1,158,480 A 11/1915 Gillette
1,158,481 A 11/1915 Gillette
1,288,522 A 12/1918 Cowan
1,383,516 A 7/1921 Benton
1,386,353 A 8/1921 Norton
D59,243 S 10/1921 MacLagan
1,419,187 A 6/1922 Wilson
1,477,689 A 12/1923 Burns
1,572,154 A 2/1926 McConoughey
1,749,051 A 3/1930 Watt
1,789,234 A 1/1931 Keenan
1,876,570 A 9/1932 Cesario
1,899,414 A 2/1933 Archie
1,976,987 A 10/1934 Gardner
2,108,267 A 2/1938 O'Neil
2,151,265 A 3/1939 Clausen
2,165,391 A 7/1939 Lewis
2,168,447 A 8/1939 Patterson
2,171,880 A 9/1939 Lewis
2,198,531 A 4/1940 Fulenwider
D123,180 S 10/1940 Pileggi
D124,684 S 1/1941 Werner
2,229,971 A 1/1941 Hammerling
2,234,440 A 3/1941 Lewis
2,237,676 A 4/1941 Lewis
2,325,868 A 5/1941 Morrow
2,252,628 A 8/1941 Grachan
2,256,326 A 9/1941 Quinio
2,270,388 A 1/1942 Stampleman
2,288,299 A 6/1942 Pileggi
2,363,894 A 11/1944 Muros
2,370,815 A 3/1945 Ross
D150,189 S 7/1948 Zurlinden
D154,784 S 8/1949 Lazar
2,488,436 A 11/1949 Santoro, Sr.
D157,063 S 1/1950 Mansfield
D157,064 S 1/1950 Mansfield
D159,994 S 9/1950 Lee
D161,784 S 1/1951 Palmer
2,536,485 A 1/1951 Behr
2,568,368 A 9/1951 Sayer et al.
2,580,058 A 12/1951 Willhelm
2,587,964 A 3/1952 Burns
RE23,505 E 5/1952 Davis
2,615,243 A 10/1952 Brown
2,615,244 A 10/1952 Mansfield
D169,147 S 3/1953 Lamb
2,633,635 A 4/1953 North
2,641,055 A 6/1953 Mansfield
2,661,529 A 12/1953 Infantino
2,663,930 A 12/1953 Di Zazzo
2,670,533 A 3/1954 Kearney
2,703,449 A 3/1955 Haynes
2,725,886 A 12/1955 Gagliano
2,746,144 A 5/1956 Spanel
2,766,521 A 10/1956 Benvenuti
2,810,953 A 10/1957 Brody
2,814,865 A 12/1957 Sunich
2,834,357 A 5/1958 Gould
2,840,901 A 7/1958 Narizzano
2,858,835 A 11/1958 Parziale
2,866,984 A 1/1959 Plough
2,869,229 A 1/1959 Hightower
2,896,320 A 7/1959 Caplan
2,900,718 A 8/1959 Bailey
2,952,907 A 9/1960 Miller
2,959,853 A 11/1960 Mercer
2,967,354 A 1/1961 Ahlborn
2,972,187 A 2/1961 Gore
D190,580 S 6/1961 Christensen
3,041,721 A 7/1962 Quinio, Sr.
3,054,180 A 9/1962 Gore
3,084,430 A 4/1963 Pacitti
D195,954 S 8/1963 Chrislcnscn
3,106,020 A 10/1963 Tape
D197,588 S 2/1964 Macon
3,138,865 A 6/1964 Meyer
3,238,616 A 3/1966 Eweson
3,259,978 A 7/1966 Weichselbaum
D205,453 S 8/1966 Christensen
D208,619 S 9/1967 Baker
3,358,367 A 12/1967 Bartley
3,384,960 A 5/1968 Solomon
D211,443 S 6/1968 Tin
3,402,467 A 9/1968 Manahan
3,413,720 A 12/1968 Mullen
3,421,213 A 1/1969 Pawlikowski
D219,501 S 1/1970 Trevor
3,500,539 A 3/1970 Muros
3,536,080 A 10/1970 Player
3,570,121 A 3/1971 Graceffo
3,571,927 A 3/1971 Stone
3,599,327 A 8/1971 Calandra
3,644,992 A 2/1972 Bennett et al.
3,646,672 A 3/1972 Braginetz
3,675,323 A 7/1972 Braginetz
3,768,161 A 10/1973 Miller
3,805,381 A 4/1974 Broussard
3,816,912 A 6/1974 Glaberson
3,816,913 A 6/1974 Ferraro
D232,874 S 9/1974 Koblick
3,834,017 A 9/1974 Tolmie
D235,696 S 7/1975 Krupski
3,895,437 A 7/1975 DiBuono
3,969,817 A 7/1976 DiBuono
3,986,258 A 10/1976 Liedtke
4,009,517 A 3/1977 Horn
4,011,656 A 3/1977 Liedtke
4,020,549 A 5/1977 Edwards
4,026,016 A 5/1977 Nissen
4,069,580 A 1/1978 Cartwright et al.
4,074,429 A 2/1978 Roberts
4,094,066 A 6/1978 Daniel, Jr.
4,163,316 A 8/1979 Hagmann et al.
4,198,746 A 4/1980 Trotta
D259,743 S 6/1981 Hollinger
4,281,456 A 8/1981 Douglass et al.
RE30,913 E 4/1982 Cartwright et al.
4,335,509 A 6/1982 Smith
4,344,226 A 8/1982 Blake, III
4,346,721 A 8/1982 Molaro
4,378,633 A 4/1983 Jacobson
4,401,129 A 8/1983 Luque
4,409,735 A 10/1983 Cartwright et al.
4,441,252 A 4/1984 Caves
4,446,619 A 5/1984 Jacobson
4,461,078 A 7/1984 Carreker
4,501,066 A 2/1985 Sceberras
4,512,077 A 4/1985 Tanabe et al.
4,562,644 A 1/1986 Hitchens
4,599,793 A 7/1986 Iten
4,663,841 A 5/1987 Custer
4,692,986 A 9/1987 Motta
4,709,475 A 12/1987 Phung
4,712,300 A 12/1987 Hemmeter
4,741,103 A 5/1988 Hultman

(56) References Cited

U.S. PATENT DOCUMENTS

| | | | |
|---|---|---|---|
| 4,768,528 | A | 9/1988 | Steele |
| 4,831,731 | A | 5/1989 | Elits |
| 4,850,107 | A | 7/1989 | Valliades |
| 4,893,641 | A | 1/1990 | Strickland |
| 4,905,372 | A | 3/1990 | Willis |
| 4,912,846 | A | 4/1990 | Yu |
| 4,928,716 | A | 5/1990 | Greene |
| 4,955,136 | A | 9/1990 | Diaz-Rivera |
| D312,144 | S | 11/1990 | Buba |
| D314,247 | S | 1/1991 | Amit |
| 5,009,003 | A | 4/1991 | Grange |
| 5,010,645 | A | 4/1991 | Furukawa |
| 5,031,316 | A | 7/1991 | Oldroyd |
| 5,031,319 | A | 7/1991 | Althaus |
| 5,167,069 | A | 1/1992 | Quinn |
| 5,129,157 | A | 7/1992 | Wood |
| 5,220,728 | A | 6/1993 | Ueno et al. |
| 5,236,439 | A | 8/1993 | Kozikowski |
| 5,333,383 | A | 8/1994 | Ferraro |
| 5,343,622 | A | 9/1994 | Andrews |
| 5,351,356 | A | 10/1994 | Townsend |
| D352,568 | S | 11/1994 | Meisner |
| D353,941 | S | 1/1995 | O'Hearn |
| D354,626 | S | 1/1995 | Hurwitz |
| D355,049 | S | 1/1995 | Yasui |
| 5,386,750 | A | 2/1995 | Morrison |
| 5,388,332 | A | 2/1995 | Oldroyd |
| 5,410,810 | A | 5/1995 | Gillibrand |
| 5,426,853 | A | 6/1995 | McNinch |
| D364,939 | S | 12/1995 | Scott |
| 5,522,137 | A | 6/1996 | Andrews |
| 5,524,346 | A | 6/1996 | Backhaus |
| 5,526,568 | A | 6/1996 | Copelan |
| 5,560,746 | A | 10/1996 | Willow |
| 5,643,403 | A | 7/1997 | Poole |
| 5,673,711 | A | 10/1997 | Andrews |
| 5,704,127 | A | 1/1998 | Cordio |
| D391,021 | S | 2/1998 | van Oene |
| 5,771,589 | A | 6/1998 | Kim |
| 5,771,591 | A | 6/1998 | Armbruster |
| 5,778,535 | A | 7/1998 | Ledesma |
| 5,787,594 | A | 8/1998 | Estrada |
| 5,802,720 | A | 9/1998 | Pribe |
| 5,802,721 | A | 9/1998 | Wain |
| 5,911,480 | A | 6/1999 | Morgan |
| 5,933,960 | A | 8/1999 | Avidor |
| 5,944,032 | A | 8/1999 | Masterson |
| 6,018,877 | A | 2/2000 | Greene |
| 6,032,372 | A | 3/2000 | Dischler |
| 6,041,503 | A | 3/2000 | Calwell |
| 6,058,608 | A | 5/2000 | Wruck |
| D428,667 | S | 7/2000 | Christian |
| 6,082,007 | A | 7/2000 | Andrews |
| 6,094,820 | A | 8/2000 | Adachi |
| 6,112,421 | A | 9/2000 | Greene |
| 6,125,857 | A | 10/2000 | Silber |
| 6,141,875 | A | 11/2000 | Andrews |
| D435,316 | S | 12/2000 | Chenvainu |
| 6,161,288 | A | 12/2000 | Andrews |
| 6,164,290 | A | 12/2000 | Andrews |
| 6,189,222 | B1 | 2/2001 | Doyle |
| 6,249,973 | B1 | 6/2001 | Hirano |
| 6,266,888 | B1 | 7/2001 | Zowaski |
| 6,301,785 | B1 | 10/2001 | Kwiecien et al. |
| 6,308,416 | B1 | 10/2001 | Bosy |
| D452,046 | S | 12/2001 | Borcherds |
| 6,418,623 | B1 | 7/2002 | Marcarelli |
| 6,434,828 | B1 | 8/2002 | Andrews |
| D463,622 | S | 9/2002 | Harrington |
| 6,449,849 | B1 | 9/2002 | Hackerman |
| 6,493,950 | B1 | 12/2002 | Kludjian |
| 6,519,856 | B1 | 2/2003 | Dischler |
| D472,673 | S | 4/2003 | Carvotta |
| 6,550,148 | B2 | 4/2003 | Cecil |
| 6,581,290 | B1 | 6/2003 | Fishel |
| D476,772 | S | 7/2003 | Wonderley |
| 6,598,303 | B2 | 7/2003 | Bosy |
| 6,681,665 | B2 | 1/2004 | Calwell |
| 6,694,626 | B2 | 2/2004 | Kludjian et al. |
| 6,722,039 | B2 | 4/2004 | Kitano |
| D495,827 | S | 9/2004 | Branden |
| D495,844 | S | 9/2004 | Berti |
| D496,129 | S | 9/2004 | Ogi |
| 6,823,594 | B2 | 11/2004 | Kludjian et al. |
| D499,511 | S | 12/2004 | Wakayama |
| D500,172 | S | 12/2004 | Fields |
| 6,871,403 | B2 | 3/2005 | Clark |
| 6,886,262 | B2 | 5/2005 | Ohtsubo |
| D506,035 | S | 6/2005 | Dombrowski |
| D507,379 | S | 7/2005 | Alphonso |
| 6,915,580 | B2 | 7/2005 | Dassel |
| 6,973,730 | B2 | 12/2005 | Tomassetti |
| 7,028,407 | B2 | 4/2006 | Ehrlich et al. |
| 7,093,363 | B1 | 8/2006 | Kuo |
| 7,103,980 | B2 | 9/2006 | Leventhal |
| 7,140,115 | B2 | 11/2006 | Greene |
| D542,972 | S | 5/2007 | Pryor |
| D550,400 | S | 9/2007 | Orloff |
| D560,032 | S | 1/2008 | Lopez |
| 7,316,045 | B2 | 1/2008 | Koke |
| D563,044 | S | 2/2008 | Ramm |
| D585,157 | S | 1/2009 | Park |
| 7,475,481 | B1 | 1/2009 | Napoli |
| D587,846 | S | 3/2009 | Wonderley |
| D593,711 | S | 6/2009 | Yamamoto |
| 7,540,088 | B2 | 6/2009 | Takeshita |
| D603,096 | S | 10/2009 | Greene |
| D605,362 | S | 12/2009 | Andersen |
| D611,653 | S | 3/2010 | Marut |
| D611,654 | S | 3/2010 | Nakasuka |
| D611,655 | S | 3/2010 | Askew |
| 7,681,314 | B2 | 3/2010 | Folio |
| 7,698,823 | B1 | 4/2010 | Iadarola |
| D616,147 | S | 5/2010 | Adams |
| 7,685,720 | B2 | 5/2010 | Efthimiadis |
| 7,726,032 | B1 | 6/2010 | Hernandez |
| D621,544 | S | 8/2010 | Bommarito |
| D623,800 | S | 9/2010 | Clemons |
| 7,856,725 | B2 | 12/2010 | Marut |
| D630,378 | S | 1/2011 | Jung |
| D631,198 | S | 1/2011 | Adams |
| 7,926,183 | B2 | 4/2011 | Groh |
| D638,580 | S | 5/2011 | Adams |
| 7,934,320 | B2 | 5/2011 | Gratsias et al. |
| D640,415 | S | 6/2011 | Wonderley |
| D641,928 | S | 7/2011 | Psimadas |
| 8,006,393 | B2 | 8/2011 | Collins |
| 8,033,027 | B2 | 10/2011 | Leventhal |
| D653,395 | S | 1/2012 | Adams |
| 8,091,241 | B2 | 1/2012 | Ouchi et al. |
| D654,222 | S | 2/2012 | Coresh |
| D656,675 | S | 3/2012 | Payne |
| 8,141,258 | B1 | 3/2012 | Frisch et al. |
| D659,904 | S | 5/2012 | Gilbert |
| 8,166,658 | B2 | 5/2012 | Nakasuka |
| 8,166,661 | B2 | 5/2012 | King |
| D664,297 | S | 7/2012 | Prat-Pfister |
| 8,209,869 | B2 | 7/2012 | Royle |
| 8,307,552 | B1 | 11/2012 | Drouillard |
| D669,220 | S | 12/2012 | Otsuka |
| D669,221 | S | 12/2012 | Otsuka |
| D674,546 | S | 1/2013 | Barrow |
| D676,197 | S | 2/2013 | Boulanger |
| D678,610 | S | 3/2013 | Prat-Pfister |
| 8,413,334 | B2 | 4/2013 | Walker, Jr. et al. |
| 8,479,398 | B2 | 7/2013 | Coresh |
| 8,484,852 | B2 | 7/2013 | King |
| 8,524,207 | B2 | 9/2013 | Ellis |
| 8,539,961 | B2 | 9/2013 | Gaugler |
| 8,601,695 | B2 | 12/2013 | Hamburg |
| D698,999 | S | 2/2014 | Otsuka |
| D699,396 | S | 2/2014 | Hasegawa |
| D699,893 | S | 2/2014 | Marut |
| D700,997 | S | 3/2014 | Marut |

(56) References Cited

U.S. PATENT DOCUMENTS

| | | | | |
|---|---|---|---|---|
| 8,671,576 | B1 | 3/2014 | Hotella | |
| 8,683,641 | B2 | 4/2014 | Weinberger | |
| 8,701,291 | B2 | 4/2014 | Hirano | |
| 8,707,561 | B1 | 4/2014 | Kneier | |
| 8,726,517 | B2 | 5/2014 | Lau | |
| 8,739,411 | B2 * | 6/2014 | Kinghorn | B26B 21/42 30/30 |
| 8,782,903 | B2 | 7/2014 | Clarke et al. | |
| 8,782,911 | B1 | 7/2014 | Greene | |
| 8,839,521 | B2 | 9/2014 | Hazard | |
| 8,973,272 | B2 | 3/2015 | Moon | |
| D741,015 | S | 5/2015 | Sacks | |
| 9,032,628 | B2 | 5/2015 | Hobson | |
| 9,049,976 | B2 | 6/2015 | Blocker | |
| 9,108,328 | B2 | 8/2015 | Kneier | |
| 9,149,944 | B2 | 10/2015 | Hobson | |
| 9,193,080 | B2 | 11/2015 | Whelan et al. | |
| 9,308,658 | B2 | 4/2016 | Coviello | |
| 9,327,415 | B1 | 5/2016 | Hovsepian | |
| D766,505 | S | 9/2016 | Coviello | |
| D772,484 | S | 11/2016 | Otsuka | |
| D773,734 | S | 12/2016 | Li | |
| D776,384 | S | 1/2017 | Eldridge | |
| D776,876 | S | 1/2017 | Coviello | |
| D777,392 | S | 1/2017 | Reaux | |
| 9,604,376 | B2 | 3/2017 | Sacks | |
| D783,900 | S | 4/2017 | Coviello | |
| 9,630,332 | B2 | 4/2017 | Coresh | |
| 9,676,112 | B2 | 6/2017 | Bolcar | |
| 9,718,200 | B2 | 8/2017 | Dryfhout | |
| D798,065 | S | 9/2017 | Brilla | |
| D802,213 | S | 11/2017 | Contaldi | |
| D808,589 | S * | 1/2018 | Dryfhout | D28/48 |
| 9,937,629 | B1 * | 4/2018 | Dryfhout | B26B 21/14 |
| D825,852 | S * | 8/2018 | Dryfhout | D28/47 |
| D826,474 | S * | 8/2018 | Dryfhout | D28/47 |
| 10,131,062 | B1 * | 11/2018 | Dryfhout | B26B 21/523 |
| 10,252,431 | B2 * | 4/2019 | Dryfhout | B26B 21/521 |
| 10,315,322 | B1 * | 6/2019 | Dryfhout | A45D 27/04 |
| 10,493,643 | B1 * | 12/2019 | Dryfhout | B26B 21/4031 |
| 10,500,744 | B1 * | 12/2019 | Dryfhout | B26B 21/12 |
| 10,543,609 | B2 * | 1/2020 | Dryfhout | B26B 21/4031 |
| 2002/0023352 | A1 | 2/2002 | Mil'shtein | |
| 2003/0000039 | A1 | 1/2003 | Borcherds | |
| 2003/0014871 | A1 | 1/2003 | Coffin | |
| 2003/0177648 | A1 | 9/2003 | Zeiter | |
| 2003/0204958 | A1 | 11/2003 | Jewell | |
| 2003/0208914 | A1 | 11/2003 | Ehrlich | |
| 2004/0016126 | A1 | 1/2004 | deBlois | |
| 2004/0035003 | A1 | 2/2004 | Stiles | |
| 2004/0107585 | A1 | 6/2004 | Helmrich | |
| 2004/0128835 | A1 | 7/2004 | Coffin | |
| 2004/0177518 | A1 | 9/2004 | Leventhal | |
| 2004/0181949 | A1 | 9/2004 | Coffin | |
| 2005/0066532 | A1 | 3/2005 | Kludjian | |
| 2005/0188554 | A1 | 9/2005 | Kjemhus | |
| 2005/0198826 | A1 | 9/2005 | Segrea | |
| 2005/0241162 | A1 | 11/2005 | Nicolosi | |
| 2006/0101655 | A1 | 5/2006 | Givant | |
| 2006/0130334 | A1 | 6/2006 | Park | |
| 2006/0143926 | A1 | 7/2006 | Khubani et al. | |
| 2006/0162165 | A1 | 7/2006 | Villalobos | |
| 2007/0180700 | A9 | 8/2007 | Sander | |
| 2007/0283567 | A1 | 12/2007 | Magli | |
| 2008/0034525 | A1 | 2/2008 | Panfili | |
| 2009/0019700 | A1 | 1/2009 | Shushan | |
| 2009/0032043 | A1 | 2/2009 | Gaugler | |
| 2009/0255124 | A1 | 10/2009 | Hasbani | |
| 2010/0071214 | A1 | 3/2010 | Kinghorn | |
| 2010/0071215 | A1 | 3/2010 | Wonderley | |
| 2010/0139097 | A1 | 6/2010 | Perez-Lopez | |
| 2011/0094108 | A1 | 4/2011 | Wain | |
| 2011/0094114 | A1 | 4/2011 | Payne-Baggetta | |
| 2011/0146079 | A1 | 6/2011 | Clarke | |
| 2011/0167639 | A1 | 7/2011 | Lau | |
| 2011/0271534 | A1 | 11/2011 | Briganti | |
| 2012/0090181 | A1 | 4/2012 | Broekhuizen | |
| 2012/0110855 | A1 | 5/2012 | Allen, Sr. | |
| 2012/0151772 | A1 | 6/2012 | Moon | |
| 2012/0192427 | A1 | 8/2012 | Hazard | |
| 2012/0192431 | A9 | 8/2012 | Wain | |
| 2013/0000127 | A1 | 1/2013 | Coresh | |
| 2013/0019484 | A1 | 1/2013 | Allen | |
| 2013/0023807 | A1 | 1/2013 | Hennessey | |
| 2013/0152400 | A1 | 6/2013 | Nunez | |
| 2013/0239413 | A1 | 9/2013 | Fischer | |
| 2013/0298412 | A1 | 11/2013 | Harski | |
| 2014/0033537 | A1 | 2/2014 | Ramakrishnan | |
| 2014/0068948 | A1 | 3/2014 | Marder | |
| 2014/0109735 | A1 | 4/2014 | Shepperson | |
| 2014/0123506 | A1 | 5/2014 | Gaines | |
| 2014/0150264 | A1 | 6/2014 | Micinilio | |
| 2015/0217468 | A1 | 6/2015 | Dryfhout | |
| 2015/0320172 | A1 | 11/2015 | Spencer | |
| 2016/0107324 | A1 | 4/2016 | Robertson | |
| 2016/0151925 | A1 | 6/2016 | Gers-Barlag | |
| 2016/0158948 | A1 | 6/2016 | Eagleton | |
| 2016/0158949 | A1 | 6/2016 | Eagleton | |
| 2016/0318198 | A1 | 11/2016 | Brazley | |
| 2017/0217035 | A1 | 8/2017 | Treu | |
| 2017/0334080 | A1 | 11/2017 | Dryfhout | |
| 2017/0334081 | A1 | 11/2017 | Dryfhout | |
| 2018/0035849 | A1 | 2/2018 | Vergara | |
| 2018/0065261 | A1 | 3/2018 | Fingold | |
| 2019/0143547 | A1 * | 5/2019 | Dryfhout | B26B 21/4006 30/81 |

FOREIGN PATENT DOCUMENTS

| | | | |
|---|---|---|---|
| CN | 2363853 | Y | 2/2000 |
| CN | 201693578 | U | 1/2011 |
| CN | 102196886 | A | 9/2011 |
| CN | 202862240 | U | 4/2013 |
| DE | 102006044316 | A1 | 3/2008 |
| EP | 0615820 | A1 | 9/1994 |
| EP | 1173311 | B1 | 1/2002 |
| EP | 1356900 | A1 | 10/2003 |
| EP | 0885698 | B1 | 4/2004 |
| EP | 1537964 | B1 | 7/2010 |
| EP | 2918383 | A1 | 9/2015 |
| FR | 2909025 | A1 | 5/2008 |
| GB | 120109 | A | 10/1918 |
| GB | 2306373 | A | 5/1997 |
| JP | H07265562 | A | 10/1995 |
| JP | 9-135973 | A | 5/1997 |
| JP | 2004236766 | A | 8/2004 |
| WO | 1996004110 | A1 | 2/1996 |
| WO | WO0245921 | A1 | 6/2002 |
| WO | WO2012161449 | A2 | 11/2012 |
| WO | WO2015116561 | A1 | 8/2015 |
| WO | WO2017201075 | A1 | 11/2017 |
| WO | WO2017201080 | A1 | 11/2017 |

OTHER PUBLICATIONS

Written Opinion of the International Searching Authority dated Sep. 12, 2017 in PCT/ US2017/032949.

International Search Report dated Sep. 11, 2017 in PCT/ US2017/032956.

Written Opinion of the International Searching Authority dated Sep. 11, 2017 in PCT/ US2017/032956.

Shave from www.ishave.com downloaded Jun. 24, 2008.

Shave from www.inventorspot.com downloaded Jun. 24, 2008.

MANGROOMER from www.amazon.com/MANGROOMER downloaded Jun. 25, 2008.

RAZORBA from www.razorba.com downloaded Jun. 24, 2008.

Patent Abstracts of Japan, English Language Abstract for JP-A-2004-236766 Aug. 26, 2004 Nishida.

International Search Report dated May 13, 2015 in corresponding PCT/US2015/013009.

Written Opinion of the International Searching Authority dated May 13, 2015 in corresponding PCT/US2015/013009.

(56) References Cited

OTHER PUBLICATIONS

Search Report by the Chinese Patent Office dated Aug. 18, 2017 in Chinese patent application No. 2015800064966.
Patent Abstracts of Japan for JP9-135973A with English abstract.
Espacenet—Bibliographic data for CN2329495Y with English abstract.
Espacenet—Bibliographic data for CN2363853Y with English abstract.
Agnieszka Kozlowska, Studying Tactile Sensitivity—Population Approach, Anthropological Review, vol. 61, pp. 3-10, figs 18, tables 11, ISBN 83-86969-35-0, ISSN 0033-2003, Poznan 1998.
Sidney Weinstein, Tactile Sensitivity of the Phalanges, Perceptual and Motor Skills, 14, pp. 351-354, Southern Universities Press, © 1962.
Gemperle, F.; Hirsch, T.; Goode, A.; Pearce, J.; Siewiorek, D.; Smailigic, A. Wearable Vibro-Tactile Display. Carnegie Mellon Wearable Group, Carnegie Mellon University, 2003.
Sherrick, C. E.; Cholewiak, R. W.; Collins, A. A. the Localization of Low- and High-Frequency Vibrotactile Stimuli. Journal of the Acoustical Society of America, 88 (1), 169-179, 1990.
Verrillo, R. T. Vibrotactile Thresholds for Hairy Skin. Journal of Experimental Psychology, 72 (1), 47-50, 1966.
Zhu, B; Skin-Inspired Haptic Memory Arrays with an Electrically Reconfigurable Architecture, 2015.
Shih; Dubrowski; Carnahan; Evidence for Haptic Memory, 2009.
Van Erp, J.B.F. Tactile displays for navigation and orientation: perception and behavior (pp. 26-27), Soesterberg, The Netherlands: TNO Human Factors, 2007.
Myles; Binseel; The Tactile Modality: A Review of Tactile Sensitivity and Human Tactile Interfaces; ARL-TR-4115 report, 2007.
English Language Abstract for DE102006044316A1 Espacenet Bibliographic data Mar. 27, 2008.
Search Report and Office Action from Chinese Patent Office dated Aug. 2, 2018 in corresponding Chinese patent application 201710352681.1.
English translation of WO0245921A1 published Jun. 13, 2002.
English translation of JPH07265562A published Sep. 21, 2011.
English translation of CN201693578U published Jan. 5, 2011.
English translation of CN2329495Y published Jul. 21, 1999.
English translation of CN202862240U published Apr. 10, 2013.
FR2909025 Carlos English Abstract May 30, 2008.
EP0615820 Schwarz English Abstract Sep. 21, 1994.

* cited by examiner

SAFETY RAZOR WITH COMB AND BLADE

The instant patent application is a Divisional (DIV) of U.S. Pat. No. 10,131,062 granted on Nov. 20, 2018 from U.S. patent application Ser. No. 15/156,850 filed on May 17, 2016 by the same inventor which was a Continuation-in-part (CIP) of U.S. Pat. No. 9,718,200 granted Aug. 1, 2017 from U.S. patent application Ser. No. 14/170,269 filed on Jan. 31, 2014 by the same inventor.

BACKGROUND OF THE INVENTIONS

1. Technical Field

The present inventions relate to safety razors and, more particularly, relate to razors for soft cut shaving and dry shaving.

2. Description of the Related Art

Safety razor blades have had assemblies where a cutting blade is surrounded by flexible portions or guards within a construction assembly used to house the cutting blade and are generally flexible for the purposes of temporarily allowing a greater cutting blade exposure when force is manually applied and when force is withdrawn the cutting blade exhibits less exposure. The cutting blades within these prior safety razor blades are typically fastened rigidly in order to disallow the cutting blade to move in relation to the housing cartridge of the safety razor blade. We often see the housing or cartridge of the prior safety razors adjusting in order to contour to challenging surfaces while the blade is anchored in place for the purpose of remaining rigid. These characteristics prove beneficial in creating and allowing for a clean close shave cutting hairs as close as possible. Therefore, getting the cleanest and closest shave is often a primary competitive factor between shaving companies. In fact, in today's market we even see multiple rows of cutting blades rigidly in place in order to continue this trend. Because of the closeness these safety razors offer and because of the level of cutting blade exposure to one's skin we find that shaving cream is a necessary promoted lubricant in the shaving method in order to prevent cutting or bleeding. These safety razors were typically created for men who seek to shave their face as well as women who seek to shave their legs. Most prior art configurations illustrate flexible guards or a safety razor cartridge housing in order to safely contour a straight edge razor along the many curves that typically exist on a face of a man or legs of a woman while cutting hair as close as possible in order to promote the smoothest shave attainable.

Examples of safety blade prior art are exhibited herein. One example is illustrated in U.S. Pat. No. 3,500,539 by Muros.

Another example of a prior art is U.S. Pat. No. 4,409,735 by Cartwright, wherein we see a shaving geometry that promotes a flexible cutting blade cartridge that offers more controlled flexibility when protruding a skin surface along the elongated side.

Yet another prior art is EP Patent 1,537,964 by Pennella et al., wherein we see a wet shaving geometry that incorporates guard elements. The guard elements are staggered alongside the sharp edge of the razor while perpendicular and bisecting each razor row.

Yet another prior art is U.S. Pat. No. 5,031,316 by Oldroyd wherein we see another illustration wherein a supporting member or guard surrounds the flexible cutting blade allowing a level of protection while the sharp edge of the cutting blade protrudes the skin surface.

Yet another prior art is U.S. Pat. No. 2,670,533 by Kearney, wherein we see another illustration that similar to the U.S. Pat. No. 3,500,539 by Muros wherein the cutting blade protrudes into a skin surface which in turn allows an overexposure of a rigid cutting blade.

Yet another prior art is U.S. Pat. No. 2,725,886 by Gagliano, wherein there is illustrated a comb or like structure used for cutting or trimming hair on one's head but the prior art does not have a supporting inner guard, predetermined base, nor a void used to assist in creating the shaving geometry illustrated in embodiments of the present inventions.

Yet another prior art is U.S. Pat. No. 6,094,820 by Adachi, wherein there is illustrated a razor comb blade unit intended for cutting or trimming hair on one'. However, the cutting blade in this example is slidably held in the blade holder leaving no base, void or gap to allow a desired cutting blade flexibility as described in the embodiments of the present inventions.

Yet another prior art is U.S. Pat. No. 8,413,334 by Walker, wherein there is illustrated a more recent art form where we are presented again a purposely rigid cutting blade that is rigidly anchored into place in order to allow the safety blade housing or cartridge to alone provide a level of safety through the depth margin of slots or grooves between each tooth in the comb guard.

SUMMARY OF THE INVENTIONS

Thus, it is an object of the present inventions to provide a safety shaving razor blade that allows wet and dry shaving capabilities and the like.

It is still another object of the present inventions to minimize accidental cutting, nicking or razor burn from the sharp edge of the cutting blade which can often be negative results of shaving without applying shaving cream.

It is another object of the present inventions to provide such a razor blade that will eliminate the need to use a hair trimmer prior to shaving with a straight edge razor blade.

It is yet another object of the present inventions to provide such a razor blade that will cut hair at or slightly below a skin surface but not to the depth at which other safety razors provide. Thus, the shaving geometry eliminates the need of shaving cream in order to protect the skin surface from cutting or nicking.

It is still another object of the present inventions to provide such a razor blade that will allow an individual the choice to choose whether to dry shave without the application of water and/or shaving cream or to choose to apply shaving cream or shaving lubricant and/or water to one's back side during the shaving process such as in the shower.

It is still another object of the present inventions to allow certain individuals who may have extremely sensitive skin or even viruses such as MERSA the ability to shave certain areas without irritation the infected skin surface which when using an overly exposure cutting blade tends to irritate, flare up and spread a virus.

It is still another object of the present inventions to offer a quick and easy shave during situations where a medical emergency may occur. An example of this could be using embodiments of the present inventions in the effect that a medical team may need to shave an individual chest in order to apply defibrillator in order to control heart fibrillation when applying an electric current to the chest wall.

It is still another object of the present inventions to eliminate the user of batteries and moving parts which are all too often found when using electronic devices.

It is still another object of the present inventions to eliminate the use of a device that possess moving parts which tends to break down and cause returns when selling through distributors, wholesalers and retailers.

It is still another object of the present inventions to offer a device that maintains a handle of which can accept its replacement shaving blades as well as accepts a device used to lubricate one's back with a shaving cream or gel type of lubricant prior to shaving.

It is still another object of the present inventions to offer a device that can be folded into a smaller more compact size that would be easily stored in a convenient space such as on the wall of one's shower and such. Folding the device would also prove efficient when selling in retail stores in that it would save space which is very important to retailers.

It is still another object of the present inventions to offer a shaving device that would allow handicapped individuals access easily and effectively shave "hard-to-reach" areas such as their legs without the effort that is normally required when using a traditional straight edge shaver handle and razor blade.

It is still another object of the present inventions to create a razor blade that could act as a handle itself or adhere to a handle that could be used for any part of the body.

It is still another object of the present inventions to create a razor that could prove beneficial for prepping during medical surgery or in an emergency matter time is crucial and shaving must be performed rapidly.

It is still another object of the present inventions to create a razor that could prove beneficial for use in rehabilitation centers such as prisons or detention centers where safety is important.

There is a need for a safety razor blade with outer teeth, outer teeth edge, deep void, inner guard, inner guard edge and an integrated cutting blade whereby deep void is intermediate of cutting blade and outer teeth.

The present inventions are illustrated by way of example and are not limited by the accompanying figures, in which like references indicate similar elements. Elements in the figures are illustrated for simplicity and clarity and have not necessarily been drawn to scale.

The details of the preferred embodiments and these and other objects and features of the inventions will be more readily understood from the following detailed description when read in conjunction with the accompanying drawings wherein:

DETAILED DESCRIPTION OF THE PREFERRED EMBODIMENTS

Figure 1:
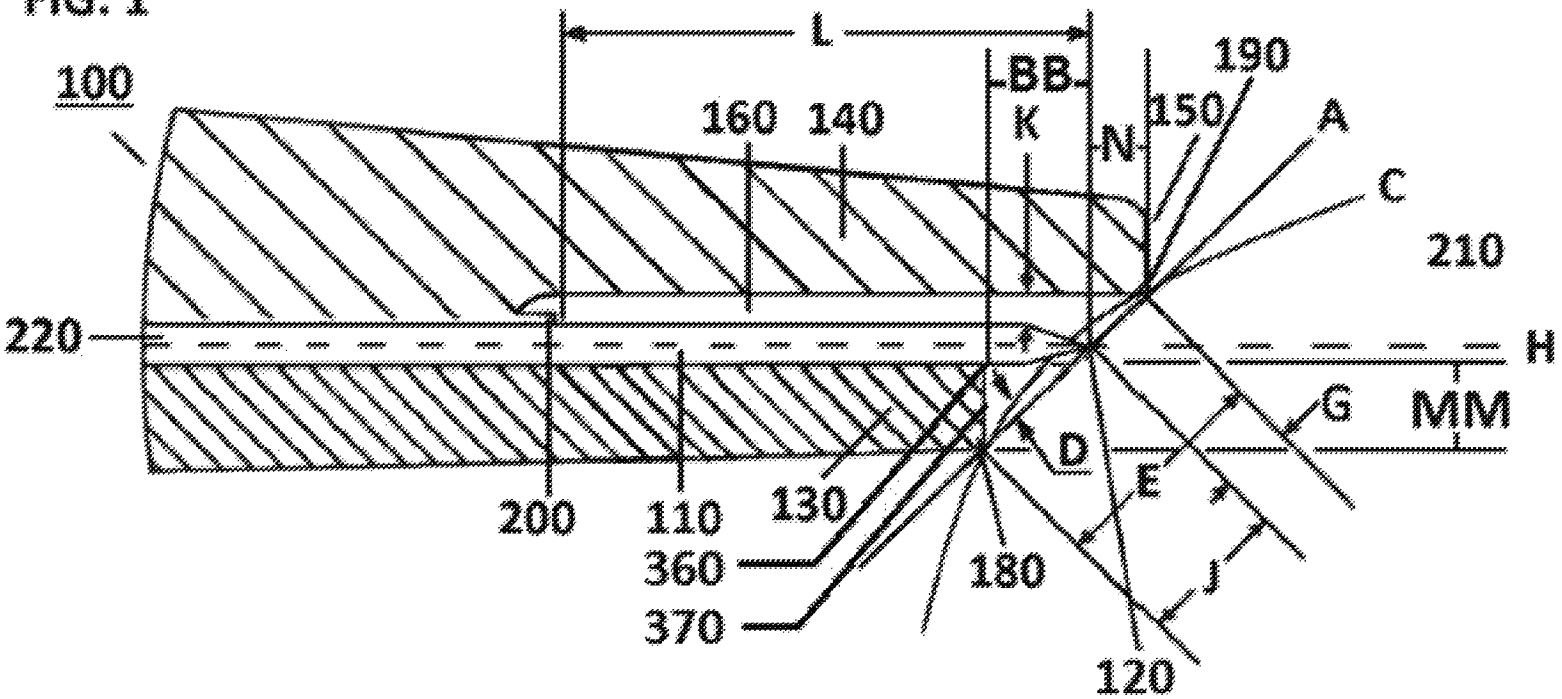
FIG. 1 is a schematic cross-sectional view of a razor blade shaving geometry wherein a cutting blade engages alongside skin surface in a first position according to a first embodiment of the present inventions.

FIG. 1 is a schematic cross-sectional view of a razor blade shaving geometry illustrating a skin surface contour A, an outer comb 140, an outer teeth tip 150, an outer teeth inside edge 190, an inner guard 130, an inner guard edge 180, a base 200, a deep void 160, a cutting blade 110 and a sharp edge 120 of cutting blade 110 wherein sharp edge 120 engages alongside skin surface contour A in a first position; and alongside inverted skin surface contour C in a second position while the opposite side view of this embodiment being identical according to a first embodiment of the present inventions. As illustrated in FIG. 1 a safety razor 100 with an outer comb 140 and cutting blade 110 and a shaving geometry coinciding with present inventions. A cutting blade 110; a sharp edge 120 at the end of a cutting blade 110; an inner guard 130; an outer comb 140; an outer teeth tip 150; a deep void 160; an inner guard edge 180; an inside edge 190 of outer teeth tips 150; a base 200; an elongated side 210; and a cutting blade end 220 whereby in one embodiment illustrated in FIG. 1 the members engaging in a first position or in other words making initial contact with skin surface contour A includes the inside edge 190 of the outer teeth tip 150, the sharp edge 120, and the inner guard edge 180 wherein a skin surface contour A is defined by the inside edge 190 of outer teeth tips 150 and the inner guard edge 180 of the inner guard 130.

In the first embodiment the sharp edge 120 of the cutting blade 110 does not protrude the skin planar surface A. As will be seem in each of the first through the fourth embodiments, the sharp edge 120 of the cutting blade 110 does not protrude the skin planar surface A. A cutting blade 110 made of stainless steel extends along a path intermediate of a deep void 160 and inner guard 130. It should be known the preferred cutting blade 110 exposure is less than about 0.030 inches (about 0.0762 centimeter). A strong opposing force of at least 10 pounds (4.536 kilograms (10 pounds)) may be applied while protecting and minimizing cutting or nicking on a skin surface when the apparatus engages.

A sharp edge 120 opposite of cutting blade end 220 is dependent on shaving blade geometry in order to produce greater or lesser friction. One characteristic in creating a lesser friction between sharp edge 120 of cutting blade 110 and a skin surface contour A is presented in this invention wherein a sharp edge 120 of a cutting blade 110 is prohibited from protruding said skin surface contour A. In the efforts to promote less friction, the level of distance between the base 200 and the sharp edge 120 of the cutting blade 110 will be substantial. Flexibility of cutting blade 110 is dependent upon the distance exhibited between a base 200 and sharp edge 120 wherein the greater the margin of distance the more flexibility is exhibited which results in less friction between sharp edge 120 and skin surface when opposing force is applied. An extremely decreased level of friction by an extremely flexible cutting blade 110 wherein said sharp edge 120 of cutting blade 110 does not protrude flat plane of a skin surface contour A and allows for a shave where lubricant is not a recommended application. The less the level of distance between base 200 and sharp edge 120 the more rigid and less flexible the cutting blade 110. Thus, a more rigid cutting blade 110 would be the result of an increased level of friction between sharp edge 120 of a cutting blade 110 and a skin surface.

An inner guard 130 is a supporting member mounted adjacent of said cutting blade 110 where, within said shaving geometry, inner guard 130 embodies an inner guard edge 180 which with an inside edge 190 of outer teeth tips 150 together create skin surface contour A. Inner guard edge 180 may have teeth wherein teeth possess a web covering in order to hide shorn hairs as will later be further disused and illustrated in FIG. 17. Overall preferred distance from inner guard edge 180 to outer teeth inside edge 190 of outer teeth tips 150 is about 0.068 inches (about 0.1727 centimeter).

Figure 19:
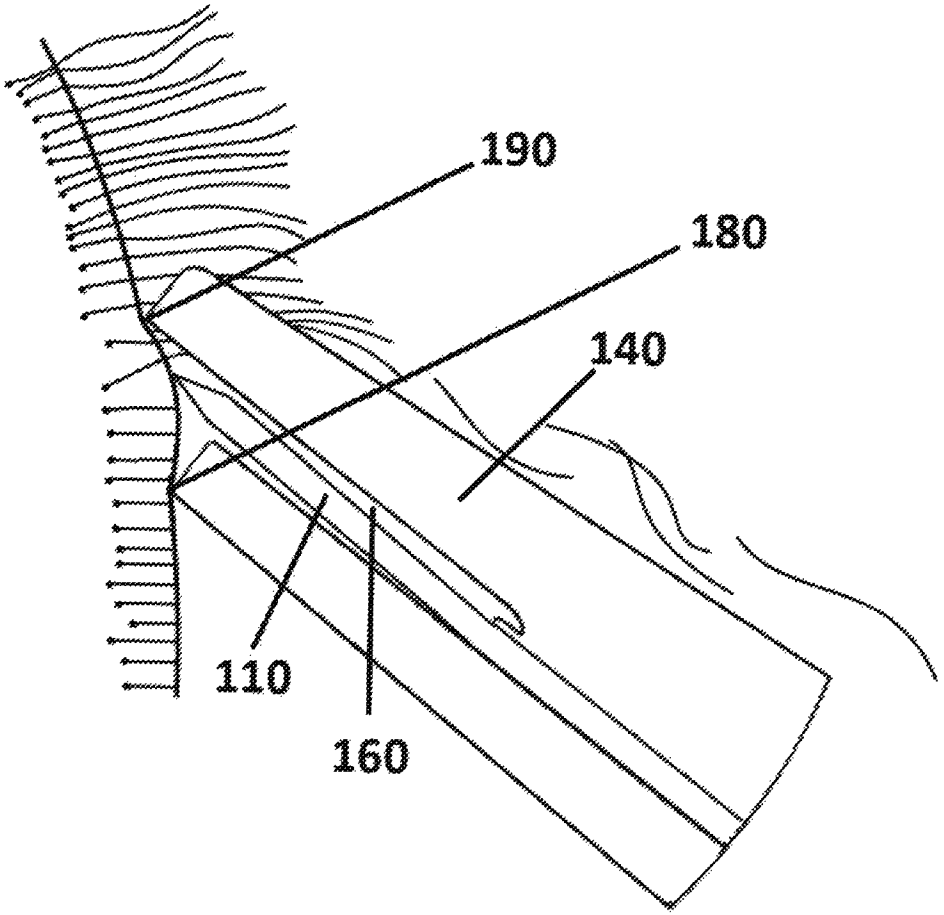
FIG. 19 is a close up view of the razor blade cutting hair along the back side of an individual according to first embodiment of the present inventions.

An outer comb 140 having elongated side 210 a row of outer teeth tips 150 and allowing shorn hair to exit the safety razor rearward of outer teeth inside edge 190 as illustrated in FIG. 19. Outer teeth tips 150, in a preferred embodiment as illustrated in FIG. 1-7 are no more than 0.032 inches (0.08128 centimeter) outside of sharp edge 120 of cutting blade 110. The outer comb 140 is preferably made from injected molded plastic or flexible plastic material used in many of the prior art shaving assemblies and typically well acceptable by customers seeking shaving products as they are durable and productive. The outer comb 140 may also be manufactured of stainless steel or chrome in order to cater to an audience seeking a higher quality product which is common in the wet shaving industry market. An inside portion of the outer comb 140 removed in order to create a deep void 160.

A deep void 160 is spaced intermediately of outer teeth tips 150 and cutting blade 110. Deep void 160 in a preferred embodiment having a preferred thickness "K" of 0.014 inches (0.03556 centimeter) or less in order to control overexposure and over flexibility of said cutting blade 110. The thickness K as described is can be measured between inner side of comb and inner side of the cutting blade 110. The deep void 160 level of thickness limits the level of flexibility of the cutting blade 110 and plays an important role in the preferred level of friction displayed between the sharp edge 120 of a cutting blade 110 and a the skin surface contours in FIGS. 1-4. Although said deep void 160 may run thicker than 0.014 inches (0.03556 centimeter) a dangerous level of friction is presented wherein greater exposure of sharp edge 120 of cutting blade 110 is presented. Deep void 160 also maintains a length which is referenced as "L" in FIGS. 1-7. However, the length of L plays a vital role in FIG. 1-4 in that the L represents the distance from base 200 to sharp edge 120 of cutting blade 110. It is important to remember that in seeking to prevent a dangerous level of sharp edge 120 exposure the opening between the sharp edge 120 of the cutting blade 110 and an inside edge 190 of the outer teeth tips 150 of the outer comb 140 has a dimension less than or equal to a dimension of an opening between the sharp edge 120 of the cutting blade 110 and an inner guard edge 180 of the inner guard 130. Dimension of said deep void 160 is chosen to control the level of flexibility of a cutting blade 110 in order to shave hairs effectively while maintaining a level of friction that reduces the risk of cutting or bleeding. When beginning the shaving process an individual embracing the safety razor 100 makes initial contact to their skin surface on the skin surface contour A which is referred to as "first position". The distance from the inside edge 190 of the outer teeth tips 150 to the inner guard edge 180 define the skin surface contour A or the first position. In certain embodiments as illustrated by FIG. 1 and FIG. 6 the sharp edge 120 of cutting blade 110 is also engaged in first position along a skin surface contour A. When said sharp edge 120 of cutting blade 110 is engaging in a first position said sharp edge 120 will not protrude the skin surface contour A. As can be seen and will be further described cutting blade 110 in FIG. 3 engages in the second position.

The skin surface contour A is flat when not pressed by the safety razor 100. When the safety razor 100 is pressed against the skin surface contour A during shaving, the skin surface contours B or C result as illustrated in FIG. 1, depending on how hard it is pressed. The outer comb 140 and the inner guard 130 press against the skin surface creating two impressions and a convex skin surface contour B or C therebetween. This convex surface of the skin raises the skin closer to the sharp edge 120 for a closer cut of the hair. In some instances the convex skin surface may be considered protuberant.

The skin surface contours B or C have a convex skin surface contour between a pair of skin indents respectively created between both the outer comb 140 and the inner guard 130. When both the inside edge 190 of the outer comb 140 and the inner guard edge 180 of the inner guard 130 press into the skin, the recessed sharp edge 120 moves relatively closer towards the skin surface contour B or C of the skin when cutting the hair.

The outer comb 140 and the inner guard 130 simultaneously touch the skin surface during shaving and can also firmly press respective indents into the skin surface during shaving. Thus the convex contour between a pair of skin indents is respectively created between both the outer comb 140 and the inner guard 130 pressing into the skin surface. Because the present inventions are suitable for dry shaving, without a shaving cream or surface lubricant, the inner guard 130 can firmly press against the skin surface and there is no concern about shaving cream or skin lubricant removal by scraping from the skin surface before the skin surface and hair hit the sharp edge 120 of the cutting blade 110.

Figure 2:
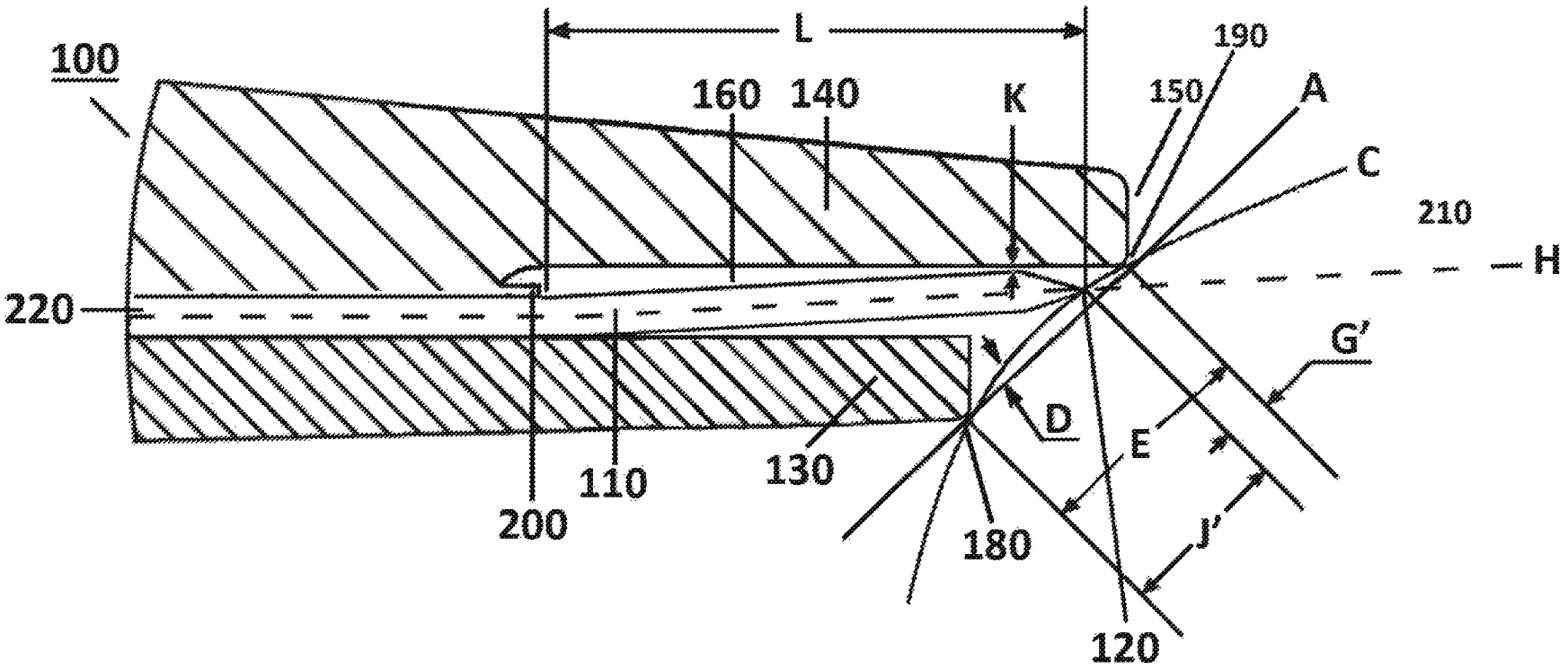
FIG. 2 is a schematic cross-sectional view of a razor blade shaving geometry wherein a cutting blade engages an opposing force of a convex skin surface contour in a second position according to the first embodiment of the present inventions.
Figure 3:
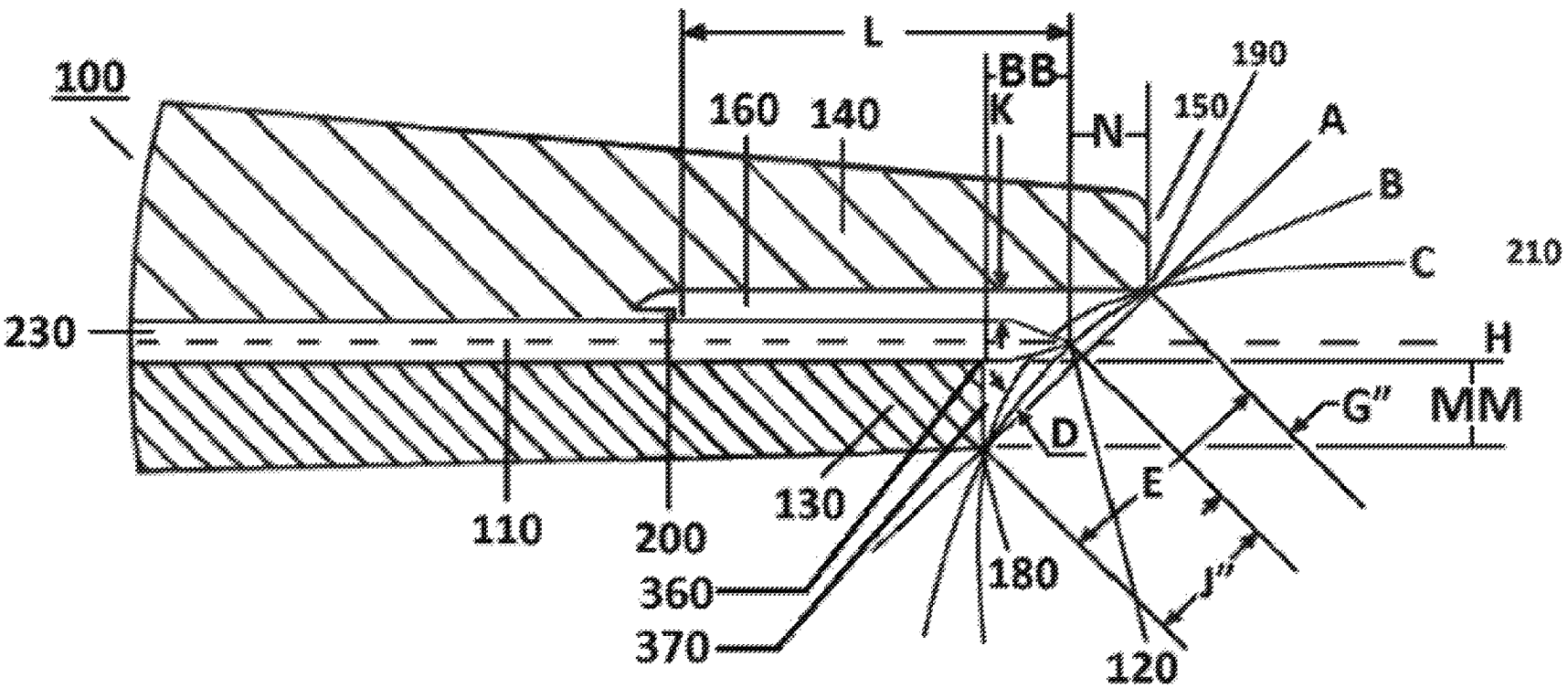
FIG. 3 is a schematic cross-sectional view of razor blade shaving geometry illustrating whereby said cutting blade is positioned inside of a skin surface contour A at inverted skin surface contour B according to a second embodiment of the present inventions.
Figure 4:
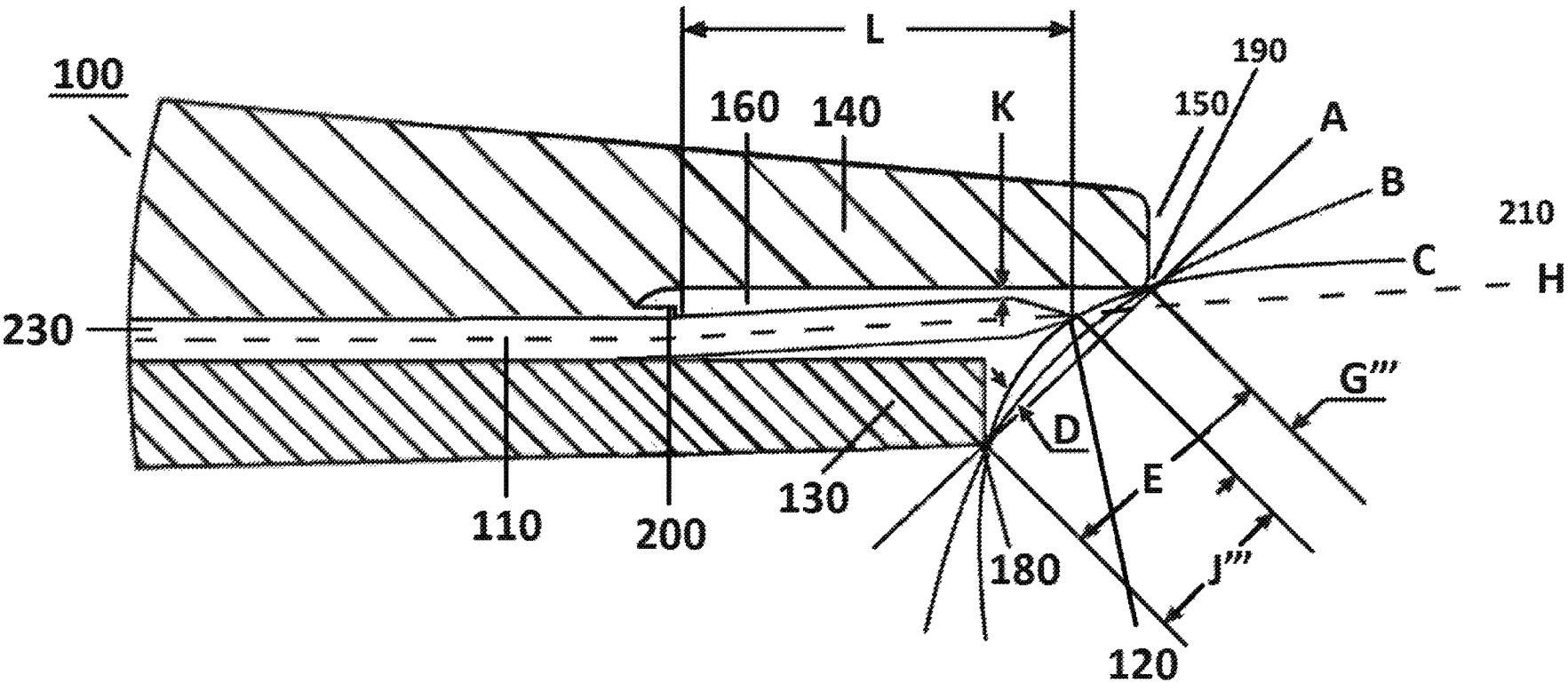
FIG. 4 is a schematic cross-sectional view of a razor blade shaving geometry whereby the base is positioned in a closer distance in comparison to FIG. 1 and FIG. 2 and said cutting blade engages a convex skin surface contour according to the second embodiment of the present inventions.

Letter designations in the drawings depict certain planes, gap distances and contours, defined throughout, and for convenience are summarily defined wherein:

"L" references the deep void 160 running lengthwise from the outer teeth tips 150 to the base 200 which allows ample space for the flexibility of said cutting blade 110 to perform "K' references the thickness of the said deep void 160 between the outer comb 140 and the cutting blade 110 which is a contributing factor in the level of flexibility the cutting blade 110 illustrates when shaving;

"A" references the skin surface contour A which is formed between the inside edge 190 of the outer teeth tips 150 and the inner guard edge 180. Skin surface contour A is also referenced as being the "first position" when safety razor 100 initially engages a skin surface contour A;

"B" references a convex skin surface contour A engaged in a convex surface contour in a second position as indicated in FIG. 3 wherein the sharp edge 120 of cutting blade 110 is engaged initially at a second position inside the original first position or skin surface contour A;

"C" references a convex skin surface contour A engaged in a convex contour whereby in FIG. 1 and FIG. 2 convex skin surface contour C is formed by cutting blade 110 flexed against an opposing skin surface force in a second position is inside the original first position and in FIG. 3 and FIG. 4 convex skin surface contour C is formed in a third position inside of the original first position A and the second position B when opposing force is applied during the shaving operation;

"D" references the margin difference between when sharp edge 120 of cutting blade 110 is flexed against opposing force versus its original position or "uninterrupted" position. In FIG. 1 and FIG. 2 reference D is the margin of difference between skin surface contours A versus C. In FIG. 3 we see reference D is the difference between convex skin surface contour B and skin surface contour C.

"E" referencing the distance of skin surface contour A or the distance between the inside edge 190 of outer teeth tips 150 and the inner guard edge 180. Reference J is always greater than or equal to G. Although a number alternative distances may exist to create an effective shaving assembly a preferred embodiment the margin of distance is about 0.068";

"J" and "J'" and "J''" and "J'''" reference the margin of distance between the sharp edge 120 of a cutting blade 110 and the inner guard edge 180. Although a number alternative distances may exist to create an effective shaving assembly a preferred embodiment the margin of distance is about 0.024";

"G" and "G'" and "G''" and "G'''" reference the margin of distance between the sharp edge 120 of a cutting blade 110 and the inside edge 190 of the outer teeth tips 150. Although a number alternative distances may exist to create an effective shaving assembly a preferred embodiment the margin of distance is about 0.018"; and "H" references to the midpoint section of a cutting blade 110.

The safety razor 100 removes hair from skin using the cutting blade 110 comprising a sharp edge 120 along an elongated side 210 of a planar surface. An outer comb 140 has a row of outer teeth 140 running along the planar surface on an outside of the cutting blade 110, each of the outer teeth of the outer comb 140 is substantially perpendicular to the sharp edge 120 and spaced with a deep void 160 between the row of the outer comb 140 and the planar surface of the cutting blade 110, wherein ends of the outer comb 140 comprise outer teeth tips 150. An inner guard 130 runs along the planar surface on an inside of the cutting blade 110. The sharp edge 120 of cutting blade 110 is recessed up to a skin surface contour A. The skin surface contour defined from the inside edges 190 of outer teeth tips 150 to the inner guard edge 180. When cutting blade 110 is flexing said cutting blade 110 longitudinally bends in a curved-like arc while sharp edge 120 of cutting blade 110 causing further recess D relative to the skin surface contour A. The sharp edge of the cutting blade can longitudinally bend to cause further recess relative to the skin surface contour. The cutting blade 110 is fixedly anchored on the cutting blade end 220 opposite the sharp edge 120.

The inner guard 130 may comprise an inner comb comprising a row of inner teeth running along the elongated side of an inside of the cutting blade 110, each of the inner teeth substantially perpendicular to the sharp edge 120.

A user for hair removal moves the safety razor 100 across skin such that the outer comb 140 extends over the cutting blade 110 to contact the hair before the hair comes in contact with the sharp edge 120. Prior to the shaving operation or flexing of the cutting blade 110 the inner guard 130 can have substantially no void between the cutting blade 110 and inner guard 130. When the safety razor 100 moves across the skin, the hair first passes through the outer comb 140 and then second the sharp edge 120 of the cutting blade 110 bends in a direction towards the outer comb 140 against a skin surface contour shortening the width of the gap G between the sharp edge 120 of the cutting blade 110 and the row of outer teeth of the outer comb 140 in FIG. 1-4 and the hair is cut by the sharp edge 120. The base 200 is positioned to create a level of distance between said base 200 and sharp edge 120 of cutting blade 110 in order to enable a controlled level of flexibility with said cutting blade 110. Outer comb 140 acts as a barrier to physically limit over bending of the sharp edge 120 of the cutting blade 110.

The safety razor 100 is moved across skin such that an outer comb 140 extends over the cutting blade 110 to contact hair before the hair comes in contact with a sharp edge 120. When moving the safety razor 100 across skin, the hair first passes through the outer teeth of the outer comb 140 and second then the sharp edge 120 of the cutting blade 110 bends in a direction to shorten the width of the gap G between the sharp edge 120 of the cutting blade 110 and the row of outer teeth of the outer comb 140 and the hair is cut by the sharp edge 120.

A deep void 160 exists between the planar surface of the cutting blade 110 and the outer comb 140 in the first and second and third and fourth embodiments of respective FIGS. 1-5. The deep void 160 extending from the outer teeth tips 150 to a base 200 of the outer comb 140. In order to create a desired "light friction" shave a preferred length of the deep void 160 reaching from outer teeth tips 150 to the base 200 is 0.180 inches (0.4572 centimeter). The closer a base 200 in distance to the sharp edge 120 of a cutting blade 110 the more rigid and less flexible the cutting blade 110 becomes and thus the level of friction increases between sharp edge 120 of a cutting blade 110 and a skin surface contour. Just the opposite, the further in distance a base 200 is to the sharp edge 120 of a cutting blade 110 the less rigid or more flexible the cutting blade 110 becomes and thus the level of friction decreases between a sharp edge 120 of a cutting blade 110 and a skin surface contour. It is important to note that aside from the position of said base 200, the degree of thickness of the deep void 160 which is represented as K plays a factor in determining the level of flexibility by which said cutting blade 110 is granted.

An opening G between the sharp edge 120 of cutting blade 110 and inside edges 190 of the outer teeth tips 150 of the outer comb 140 has a dimension G the same or less than a dimension J of an opening J between the sharp edge 120 of cutting blade 110 and an inner guard edge 180 of the inner guard 130. A dimension of the deep void 160 has a depth extending from the outer teeth tips 150 to a base 200 of the outer comb 140 substantially greater than a dimension G of the gap G. A dimension of the gap G is chosen in connection with the preferred distance of a base 200 from the sharp edge 120 of a cutting blade 110. It should be noted that the closer the base 200 is in distance to the sharp edge 120 of a cutting blade 110 the smaller the gap G becomes. The further away the base 200 is in distance to the sharp edge 120 of the cutting blade 110, the larger the gap G may become.

A problem with prior safety razors is that while they do offer a level of protection when contouring within the shaving process, it is widely known that in order to attain such a close shave that they still do require and create a cutting blade flexibility and exposure that is far too rigid to create a controlled atmosphere that would allow one to dry shave a hard-to-reach area such as one's back without application of shaving cream. More often in order to create a safety razor that navigates angles and bumps we see the safety razor 100 housing or "cartridge" being altered while the cutting blade 110 remains rigid. The strong friction is often illustrated in today's market between the sharp edge 120 of the cutting blade 110 and a skin surface which is why the application of shaving cream or shaving gel prior to shaving is recommended in order to minimize the cutting or nicking of the skin surface. The prior safety razors do not allow a controlled shaving geometry that minimizes cutting blade 110 exposure while offering a level of flexibility take place without the use of shaving cream or gel in order to greatly minimize cutting or bleeding. One common factor amongst the majority of safety razors is that the cutting blade, although engaging by guards that may assist in deflection when engaging a skin surface, often embody a cutting blade that is capable of protruding a skin surface contour A that is formed between an inner guard edge 180 and the inside edge 190 of the outer teeth tips 150. Another important missing characteristic of the prior art is that there does not exist an opening G between the sharp edge 120 of cutting blade 110 and an inside edge 190 that remains the same level of distance or less than an opening represented by J which exists between the sharp edge 120 of cutting blade 110 and an inner guard edge 180 of the inner guard 130. A final important notation is that a cutting blade 110 that is most commonly found within razors today do not embody a preferred level of distance between a sharp edge 120 and a base 200 that would allow for a proper amount of cutting blade 110 flexibility which creates an extremely light or soft level of friction between sharp edge 120 of a cutting blade 110 and a skin surface.

Furthermore, in embodiments of the present inventions there is a deep void 160 that is specified in FIG. 1 wherein said deep void 160 is embodied between the base 200 and outer teeth tips 150 and enables multiple contributing factors one of which would be the thickness of the deep void 160 represented by K which the level of thickness controls the level flexibility of cutting blade 110. This ultimately controls the level of friction allowed between sharp edge 120 of cutting blade 110 and a skin surface contour which in FIG. 1 is represented as A in the first position. These are important factors of the present inventions since creating a light traction is necessary when dry shaving and cutting at a lesser depth than a traditional over exposed and over rigid safety razor cutting blade 110. In summary, this prior art is generally designed to perform or cut hair at an aggressive level while creating a housing surrounding a cutting blade 110 or blades that create or allow a level of safety during the shaving operation. My invention, however, does not attempt to perform or cut hair at an aggressive level but instead performs or cuts at a less aggressive level. Furthermore, my invention takes advantage of the flexibility of a skin surface. The human skin is flexible and is able to bend at many contour angles. Being that in my invention a skin surface is granted ability to bend in a convex contour between a pair of skin indents respectively created between the comb and guard with an aggressively flexible cutting blade we notice a preferred level of friction throughout the shaving operation. Most prior art embodiments we see the guards or housing cartridges bending or flexing around the cutting blade wherein my invention I illustrate the cutting blade bending and flexing in relation to skin surface contour created by the fixed housing. The priority in my invention is that it cuts at a less aggressive level wherein an individual is not required to apply shaving cream or shaving lubricant to their back or back side prior to shaving in order to prevent several razor burn or cutting. It is very difficult for an individual to access their own back or back side with shaving cream without asking for assistance from another individual or without using a handle that may extend in length to access their back or back side. Thus, is proves beneficial to have a safety razor designed to allow an effective shave that does not rely on shaving cream or a shaving lubricant to be applied to dry skin prior to the shaving operation in order to protect oneself from cutting or bleeding. In addition, the cost associated with purchasing shaving cream is saved since shaving cream is not a requirement. Also, it is very scary for an individual to access their back or back side with a safety razor that does not cut at a level aggressive level of shaving friction. Not being able to accurately view your own back or back side while attempting to use a sharp safety razor is very dangerous and scary. The less aggressive level of shaving operation in my invention offers a level of protection and light friction that does not require shaving cream or a shaving lubricant to be applied to dry skin prior to the shaving operation in order to protect a skin surface from cutting or bleeding from the cutting blade. It is widely known that cutting or bleeding is a common side effect when shaving one's face with a safety razor design for one's face. Also, an area such as one's back or back side offers a surface where the larger area of skin offers more flexibility of a skin surface area which proves beneficial to my invention. The majority of allows a redundant amount of rigid cutting blade exposure when attempting to dry shave without the use of shaving cream which can lead to severe cutting or what is commonly referred to as "razor burn" to take place which is described as a skin condition featuring a red rash, bumps, or even infected blisters.

In an additional embodiment of the safety razor 100, an inner rearward distance EBB from a vertical plane of the sharp edge 120 of the flexible cutting blade 110 to a vertical plane of the to the inner guard edge of the inner guard 130 in relation to an outer rearward distance N from a vertical plane of the inside edge 190 of the outer comb 140 to a vertical plane of the sharp edge 120 of the flexible cutting blade 110 has a ratio of about 1. In other words, in this embodiment, the inner rearward distance BB and the outer rearward distance N are substantially the same. The inner rearward distance BB from the vertical plane of the sharp edge 120 of the flexible cutting blade 110 to the vertical plane of the inner guard edge of the inner guard 130 is about 0.508 mm to about 1.016 mm. A preferred inner rearward distance BB from the vertical plane of the sharp edge 120 of the flexible cutting blade 110 to the vertical plane of the inner guard 130 is about 0.762 mm. Also, the outer rearward distance N from the vertical plane of the inside edge 190 of the outer comb 140 to the vertical plane of the sharp edge 120 of the flexible cutting blade 110 is about 0.508 mm to about 1.016 mm. A preferred outer rearward distance N from the vertical plane of the inside edge 190 to the vertical plane of the sharp edge 120 is about 0.762 mm. In this discussion of an additional embodiment, the diagonal distance E, diagonal distance J, and diagonal distance G are also effected and have alternate dimensions as well. Diagonal distance E may be about 1.54 mm to about 2.54 mm. A preferred diagonal distance E is about 2.3622 mm. Diagonal distance J may be about 0.762 mm to 1.6 mm. A preferred distance J is about 1.4986 mm. Diagonal distance G may be about 0.254 mm to about 0.889 mm. A preferred diagonal distance G is about 0.8636 mm. Furthermore, the inner guard 180 having an inside end 360 and an outer edge 180 wherein the distance between the inside end 360 and the outer edge 180 is considered the inner guard 130 inside wall 370. The inside wall 370 distance is referenced as distance M. Distance M is about 0.381 mm to about 0.889 mm. A preferred distance M is about 0.61 mm. The distance M is the same or greater than a thickness "K" of a deep void 160. It is important to note that diagonal distance J is substantially equal or greater than distance G. It is important to note that the skin convex enters and stretches inside of the outer edge 180 and inside edge 190 it is preferable to have a greater diagonal distance J in comparison to diagonal distance G. Having a greater diagonal distance J allows the stretching skin convex to press against the cutting blade 110 and bending the cutting blade 110 towards the inside of the outer comb 140. If diagonal distance J was less than diagonal distance G the skin convex will have a harder time pressing the cutting blade 110 towards the inside of the outer comb 140 and the cutting blade 110 becomes more likely to poke into the skin as a dagger instead of at an cutting angle between the sharp edge 120 of the cutting blade 110 and the skin surface.

The inner edge of the inner guard 130 and the inside edge 190 of the outer comb 140 in practice are blunt or curved edges because no corner is perfectly sharp or square. If the inner edge of the inner guard 130 and the inside edge 190 of the outer comb 140 were perfectly sharp or square, they would risk cutting into the skin or feel uncomfortable. That being said, there may be a slightly square edge sufficient to indent and grip the skin in order for the skin inside of the inside edge 190 and the inner guard 130 to stretch. These ends are the outermost horizontal dimension to the end or tip of the inner guard 130 or the outer comb 140. Therefore the inner rearward distance BB and outer rearward distance N are stated measured from respective ends of the inner guard 130 and the outer comb 140. The trailing opening J takes a shape of an imaginary triangle. The imaginary triangle has three sides. The first side runs between the outer edge 180 and the plane of the cutting blade 110. The second side runs from where the inner guard 130 and the plane of the cutting blade 110 meet. The third and final side is where the flat skin plane A is inside of the sharp edge 120 and the outer edge 180. In other alternate embodiments the imaginary triangle may be a right triangle or an isosceles triangle or an isosceles right triangle. The trailing opening J cross sectional has three triangular corners or vertices which have three walls but it is not a perfect triangle being that the three walls or sides of the vertices are not always flat.

FIG. 2 is a schematic cross-sectional view of a razor blade shaving geometry wherein a cutting blade 110 engages an opposing force of a convex skin surface contour C in a second position according to the first embodiment of the present inventions. FIG. 2 illustrates a skin surface contour A or C, a comb, an outer teeth tip 150, outer teeth inside edge 190, an inner guard 130, an inner guard edge 180, a base 200 and a cutting blade 110 wherein the cutting blade 110 engages a convex skin surface in a second position; the opposite side view of this embodiment being identical according to a second embodiment of the present inventions. As illustrated in FIG. 2, while a first position is still active, a "second position" is created when an individual exercises a shaving stroke wherein an opposing force is applied allowing a determined degree of friction between sharp edge 120 of cutting blade 110 and skin surface whereby the degree of friction is determined by the sharp edge 120 of a cutting blade 110 being recessed up to a skin surface as well determined by the degree of distance a base 200 is positioned from the sharp edge 120 of a cutting blade 110. The further the distance a base 200 is positioned away from a sharp edge 120 of a cutting blade 110 the more flexibility is allowed by a cutting blade 110 which creates a lower level of friction and a softer shave. The closer the distance a base 200 is positioned from a sharp edge 120 of a cutting blade 110 the cutting blade 110 is more rigid and less flexible which creates a higher level of friction and a stronger shave. Although various measurements will create a light friction between the sharp edge 120 and a skin surface, the preferred length of the deep void 160 in creating a light friction is 0.180 inches (0.4572 centimeter) from the base 200 to the outer teeth tips 150. Furthermore, the thickness of the deep void 160 participates in controlling the level of friction between the sharp edge 120 of a cutting blade 110 and a skin surface as it limits the flexibility level of a cutting blade 110. Said sharp edge 120 of cutting blade 110 may engage in a first and second position but always along with at least one outer teeth inside edge 190 and at least one inner guard edge 180 on each opposite side of cutting blade 110. An outer teeth inside edge 190 running along the elongated side 210 of an outside of said cutting blade 110 and inner guard edge 180 running along the elongated side 210 of an inside of said cutting blade 110 As illustrated in FIG. 2 a safety razor 100 with comb and integrated blade in accordance with FIG. 1 wherein the cutting blade 110 is engaged in a second position with an opposing force wherein sharp edge 120 is flexed against a convex skin surface contour C. FIG. 2 illustrates a gentle friction between cutting blade 110 and skin surface contour which allows for an effective shave while cutting the hair a beneficial level versus the majority of straight edge razors assemblies on the market which aim to cut the hair as close as possible or even beneath the skin surface which is the reason shaving cream or shaving gel is often sold with straight razors. Skin surface contour A, in a preferred embodiment, is positioned between 20 to 50 degrees. Due to the fact that my invention cuts a hair at a less aggressive length the presence of shaving cream or gel prior to shaving is not necessary to minimize cutting or nicking of the skin surface. Furthermore, embodiments of the present inventions work better in areas of the body that have hair follicles less coarse. For example embodiments of the present inventions work better one back or arm hair which often possesses hair less coarse or thick in comparison to facial hair which is known to be thicker in nature.

FIG. 3 is a schematic cross-sectional view of razor blade shaving geometry illustrating whereby the base 200 is positioned closer in distance to the sharp edge 120 in comparison to the first embodiment in FIG. 1 and FIG. 2. When creating a less flexible cutting blade 110 in comparison to the first embodiment, it is necessary, in the spirit of maintaining a lighter friction between skin surface contour A and sharp edge 120, for said cutting blade 110 to be positioned inside of a skin surface contour A creating less cutting blade 110 blade exposure which in turn creates a lighter friction. As illustrated in FIG. 3 is a safety razor 100 with comb and integrated blade in accordance with FIG. 1 wherein the cutting blade 110 is positioned at convex skin surface contour B in a second position inside a skin surface contour A. The cutting blade 110 is fixedly anchored at a cutting blade end 230. This FIG. 3 demonstrates how when a cutting blade 110 maintains a base 200 closer in margin distance to the sharp edge 120 it is necessary to decrease the exposure of a cutting blade 110 is relation to the skin surface in order to maintain a less aggressive shaving friction.

In an additional embodiment of the safety razor 100, an inner rearward distance BB from a vertical plane of the sharp edge 120 of the flexible cutting blade 110 to a vertical plane of the inner guard edge of the inner guard 130 in relation to an outer rearward distance N from a vertical plane of the inside edge 190 of the outer comb 140 to a vertical plane of the sharp edge 120 of the flexible cutting blade 110 has a ratio of about 1. In other words, in this embodiment, the inner rearward distance BB and the outer rearward distance N are substantially the same. The inner rearward distance BB from the vertical plane of the sharp edge 120 of the flexible cutting blade 110 to the vertical plane of the inner guard edge of the inner guard 130 is about 0.508 mm to about 1.016 mm. A preferred inner rearward distance BB from the vertical plane of the sharp edge 120 of the flexible cutting blade 110 to the vertical plane of the inner guard 130 is about 0.762 mm. Also, the outer rearward distance N from the vertical plane of the inside edge 190 of the outer comb 140 to the vertical plane of the sharp edge 120 of the flexible cutting blade 110 is about 0.508 mm to about 1.016 mm. A preferred outer rearward distance N from the vertical plane of the inside edge 190 to the vertical plane of the sharp edge 120 is about 0.762 mm. In this discussion of an additional embodiment the diagonal distance E, diagonal distance J, and diagonal distance G are also effected and have alternate dimensions as well. Diagonal distance E may be about 1.54 mm to about 2.54 mm. A preferred diagonal distance E is about 2.3622 mm. Diagonal distance J may be about 0.762 mm to 1.6 mm. A preferred distance J is about 1.4986 mm. Diagonal distance G may be about 0.254 mm to about 0.889 mm. A preferred diagonal distance G is about 0.8636 mm. Furthermore, the inner guard 180 having an inside end 360 and an outer edge 180 wherein the distance between the inside end 360 and the outer edge 180 is considered the inner guard 130 inside wall 370. The inside wall 370 distance is referenced as distance M. Distance M is about 0.381 mm to about 0.889 mm. A preferred distance M is about 0.61 mm. The distance M is the same or greater than a thickness "K" of a deep void 160. It is important to note that diagonal distance J is substantially equal or greater than distance G. It is important to note that the skin convex enters and stretches inside of the outer edge 180 and inside edge 190 it is preferable to have a greater diagonal distance J in comparison to diagonal distance G. Having a greater diagonal distance J allows the stretching skin convex to press against the cutting blade 110 and bending the cutting blade 110 towards the inside of the outer comb 140. If diagonal distance J was less than diagonal distance G the skin convex will have a harder time pressing the cutting blade 110 towards the inside of the outer comb 140 and the cutting blade 110 becomes more likely to poke into the skin as a dagger instead of at an cutting angle between the sharp edge 120 of the cutting blade 110 and the skin surface.

The inner edge of the inner guard 130 and the inside edge 190 of the outer comb 140 in practice are blunt or curved edges because no corner is perfectly sharp or square. If the inner edge of the inner guard 130 and the inside edge 190 of the outer comb 140 were perfectly sharp or square, they would risk cutting into the skin or feel uncomfortable. That being said, there may be a slightly square edge sufficient to indent and grip the skin in order for the skin inside of the inside edge 190 and the inner guard 130 to stretch. These ends are the outermost horizontal dimension to the end or tip of the inner guard 130 or the outer comb 140. Therefore the inner rearward distance BB and outer rearward distance N are stated measured from respective ends of the inner guard 130 and the outer comb 140.

The trailing opening J takes a shape of an imaginary triangle. The imaginary triangle has three sides. The first side runs between the outer edge 180 and the plane of the cutting blade 110. The second side runs from where the inner guard 130 and the plane of the cutting blade 110 meet. The third and final side is where the flat skin plane A is inside of the sharp edge 120 and the outer edge 180. In other alternate embodiments the imaginary triangle may be a right triangle or an isosceles triangle or an isosceles right triangle. The trailing opening J cross sectional has three triangular corners or vertices which have three walls but it is not a perfect triangle being that the three walls or sides of the vertices are not always flat.

FIG. 4 is a schematic cross-sectional view of a razor blade shaving geometry whereby the base 200 is positioned in a closer distance in comparison to FIG. 1 and FIG. 2 and said cutting blade 110 is engages in the second position an opposing force at a convex skin surface contour C according to the second embodiment of the present inventions. The inverted skin surface contour C is a sharper arc shaped bend than the inverted skin surface contour B or the flat plane of the skin surface contour A. As illustrated in FIG. 4 is a safety razor 100 in accordance with FIG. 3 wherein the cutting blade 110 is engaged in a third position with an opposing force and sharp edge 120 is flexed against a convex skin surface contour C. The cutting blade 110 is fixedly anchored at a cutting blade end 230. When said cutting blade 110 is engaged in a third position with an opposing force the void margin indicated by K is minimized between the cutting blade 110 and the outer comb 140. FIG. 4 clearly illustrates since the distance margin between the base 200 and the sharp edge 120 is increased when compared to FIG. 1 and FIG. 2 the exposure of the cutting blade 110 is decreased. This adjustment allows a light friction to be maintained in order to create an effective shave that ultimately does not require shaving cream or lubricant in order to prevent severe cutting or nicking of a skin surface.

Figure 5:
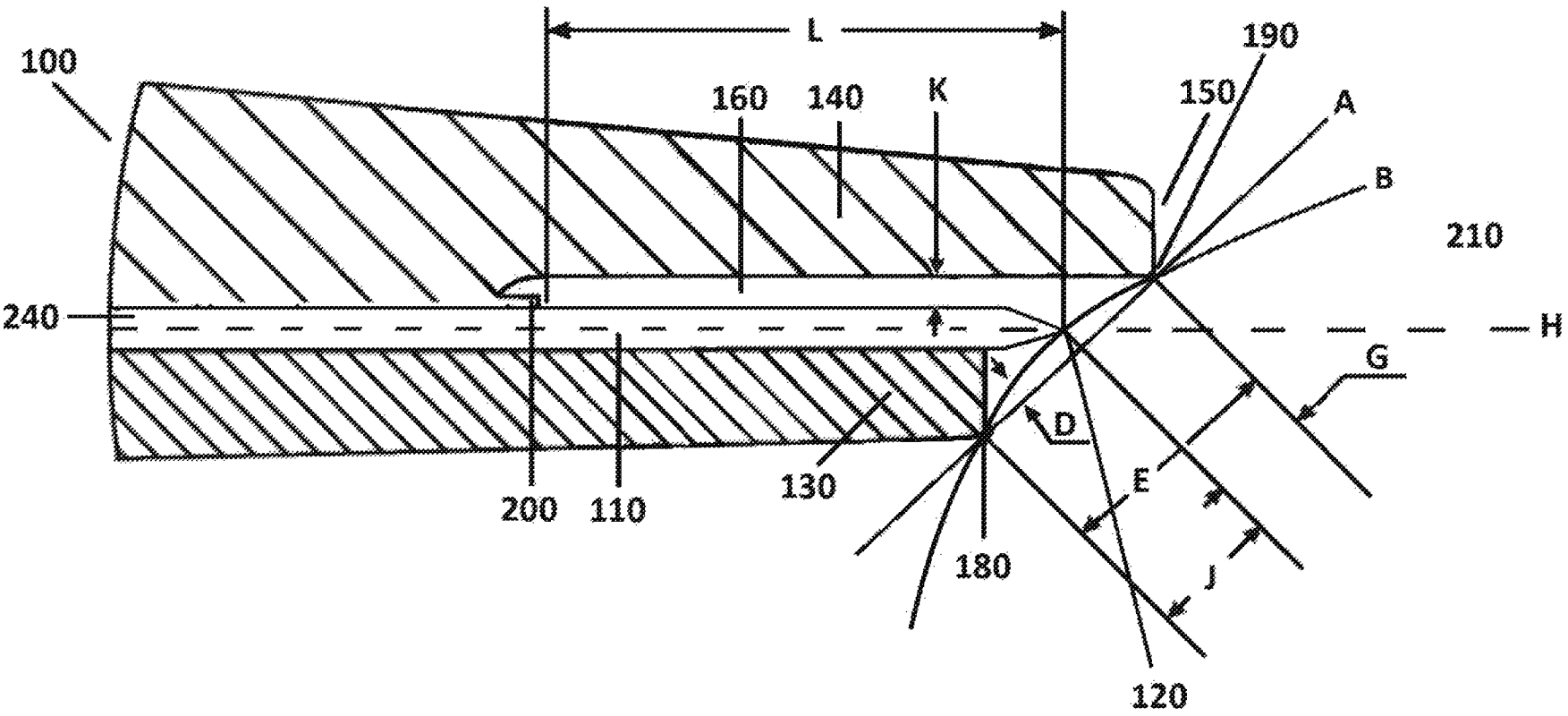
FIG. 5 is a schematic cross-sectional view of a razor blade shaving geometry whereby said cutting blade is fastened in a fixed position inside of the skin surface contour according to a third embodiment of the present inventions.
Figure 6:
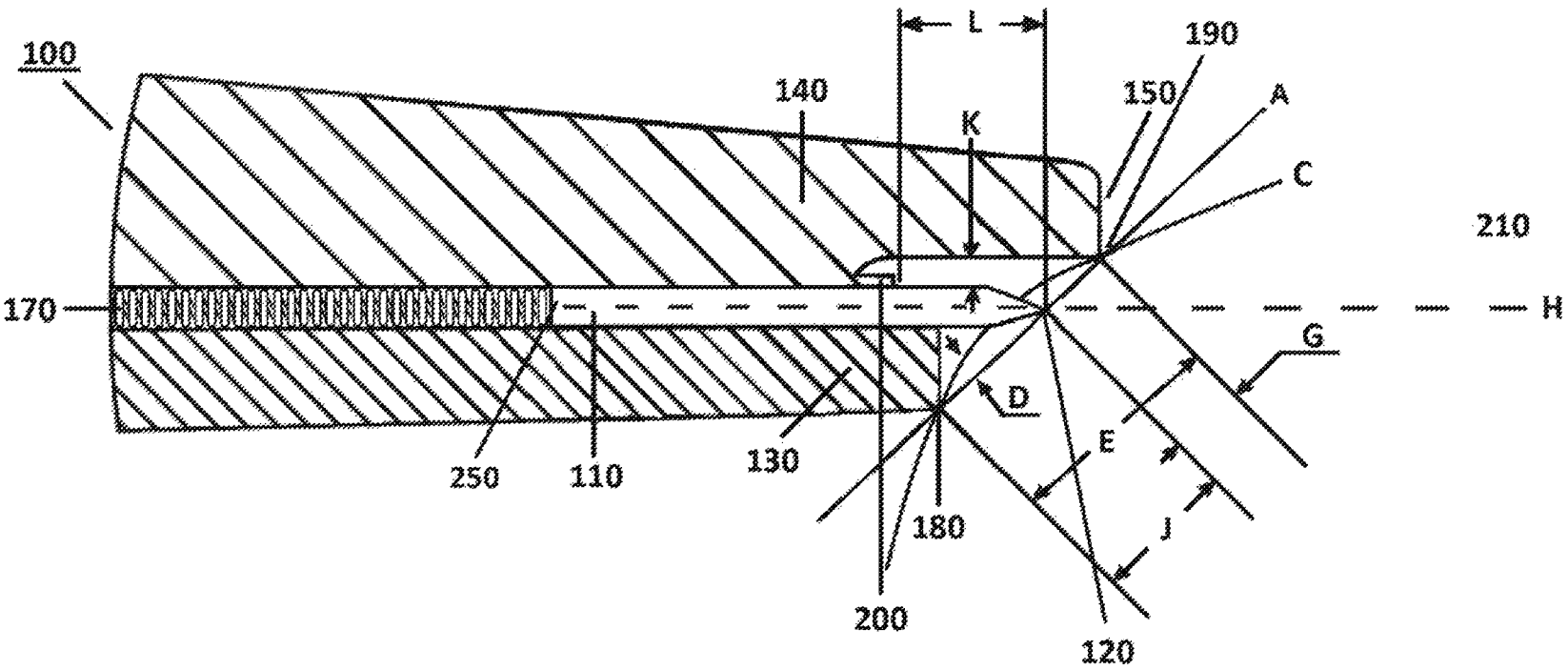
FIG. 6 is a schematic cross-sectional view of a razor blade shaving geometry whereby said sharp edge of a cutting blade is at the skin surface contour A in a first position and a spring is embodied in order to prepare for a cutting blade to engage skin surface contour in a second position according to a fourth embodiment of the present inventions.

FIG. 5 is a schematic cross-sectional view of a razor blade shaving geometry whereby the cutting blade 110 is fastened in a fixed position inside of the skin surface contour A according to a third embodiment of the present inventions. A fixedly anchored cutting blade 110 of a rigid material is substantially recessed inside the skin surface contour A of FIG. 5. As illustrated in FIG. 5 is a safety razor 100 wherein a cutting blade 110 is made from a non-flexible razor or perhaps ceramic. The cutting blade 110 is fixedly anchored between cutting blade end 240 and a base 200 wherein the sharp edge 120 remaining inside of a skin surface contour A at the same position in both the first position A and second position B for the purpose of allowing cutting accessibility while protecting the skin surface due to non-flexing attributes of cutting blade 110. Being that the cutting blade 110 in this example is made from a non-flexible razor such as ceramic the position of the base 200 to the sharp edge 120 of the cutting blade 110 is not relevant in this example.

FIG. 6 is a schematic cross-sectional view of a razor blade shaving geometry whereby said sharp edge 120 of a cutting blade 110 is at the skin surface contour A in a first position and a flexible spring 170 is embodied in order to prepare for the cutting blade 110 to engage an opposing force of a skin surface contour in a second position according to a fourth embodiment of the present inventions. As illustrated in FIG. 6 is a safety razor 100 wherein a cutting blade 110 is in an engaging first position alongside a skin surface contour A and not protruding the skin surface contour A. Illustrated in FIG. 6 is a flexible spring 170 which is implemented in order to cutting blade 110 flexibility in a different manner when compared to FIG. 2 and FIG. 4. The cutting blade 110 is fixedly anchored at a flexible spring 170. The flexible spring 170, of the fourth embodiment of FIG. 6, is operatively coupled to the cutting blade 110 on a cutting blade end 250 of the planar surface opposite the sharp edge 120, causes further recess relative to the skin surface contour A. Being that the cutting blade 110 in this example is allowed flexibility in a different manner when compared to FIG. 2 and FIG. 4 the position of the base 200 is not relevant in terms of determining a level of friction between sharp edge 120 of the cutting blade 110 and a skin surface.

Figure 7:
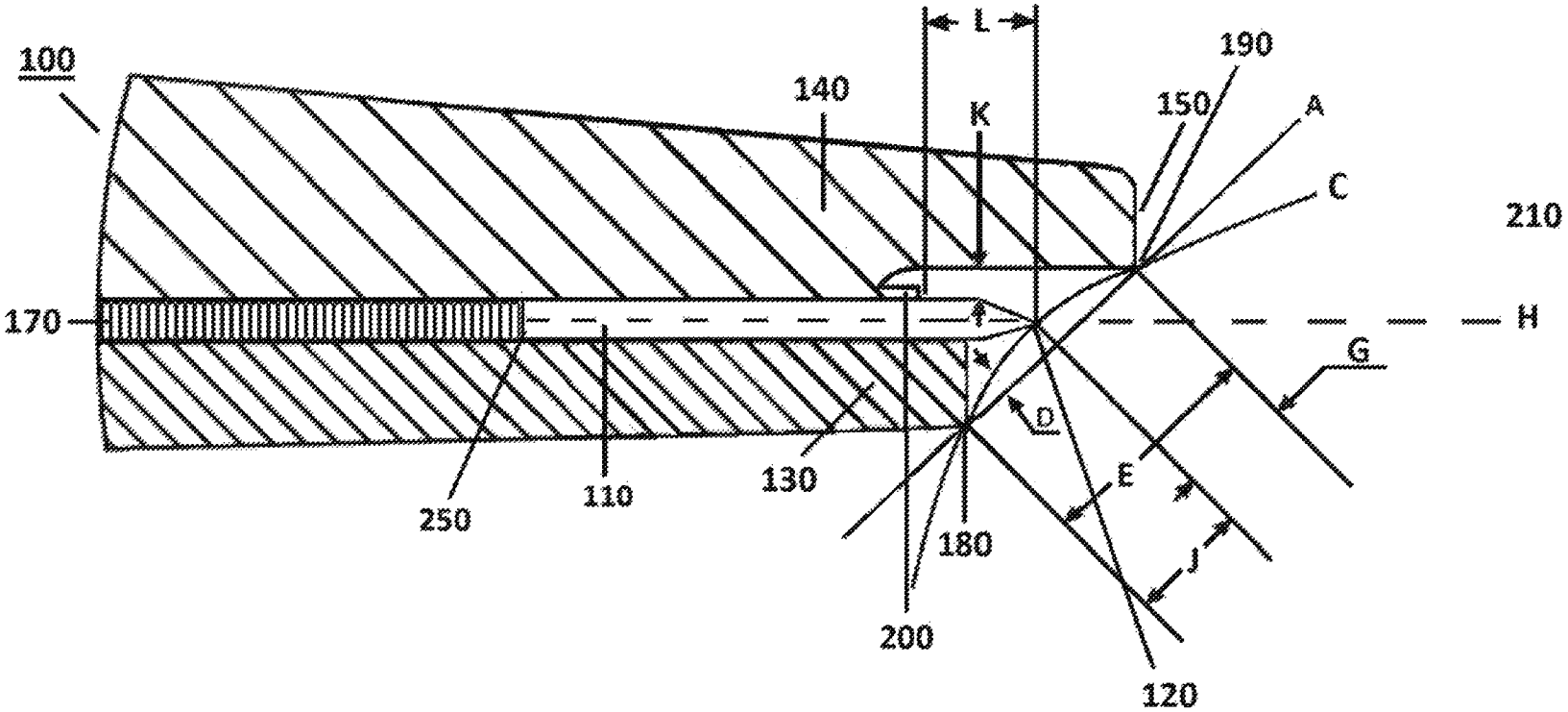
FIG. 7 is a schematic cross-sectional view of a razor blade shaving geometry whereby said cutting blade is engaged in a second position inside of the skin surface contour by a spring according to the fourth embodiment of the present inventions.

FIG. 7 is a schematic cross-sectional view of a razor blade shaving geometry whereby said cutting blade 110 is flexed and engaged in a second position C inside of the skin surface contour A by a spring according to the fourth embodiment of the present inventions. As illustrated in FIG. 7 and in accordance with FIG. 6 the cutting blade 110 is flexing due to a flexible spring 170 allowing the cutting blade 110 to retract horizontally and away from skin surface contour A. The flexible spring 170, of the fourth embodiment of FIG. 7, is operatively coupled to the cutting blade 110 on a cutting blade end 250 of the planar surface opposite the sharp edge 120, causes further recess relative to the skin surface contour A. The cutting blade 110 is fixedly anchored at a flexible spring 170. Due to the manner in which the cutting blade 110 is flexing in FIG. 7 the need for a deep void 160 is irrelevant as the cutting blade 110 is not flexing or bending towards the outer comb 140. It can be seen in FIG. 7 that the margin indicated by L is greatly reduced when engaging in a second position with an opposing force. Being that the cutting blade 110 in this example is allowed flexibility in a different manner when compared to FIG. 2 and FIG. 4 the position of the base 200 is not relevant in terms of determining a level of friction between sharp edge 120 of the cutting blade 110 and a skin surface contour. Furthermore, as illustrated in FIG. 1-6 a margin or gap represented by G in FIG. 7 is the equal to or less than the margin represented by J.

Figure 8:
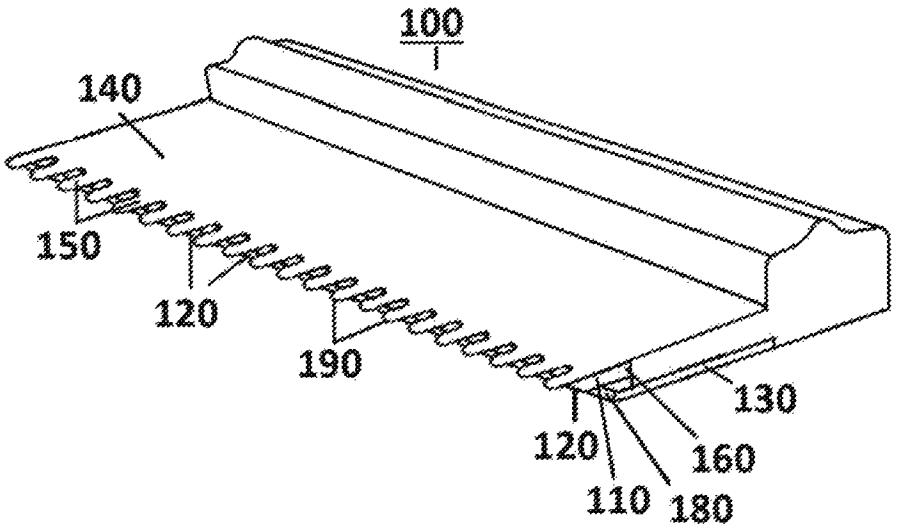
FIG. 8 is an angled elevated view of the razor blade whereby the comb portion is end up according to embodiments of the present inventions.

A FIG. 8 is an angled elevated view of the razor blade whereby the comb portion is end up. As illustrated in FIG. 8 the safety razor 100 is in an upright position.

Figure 9:
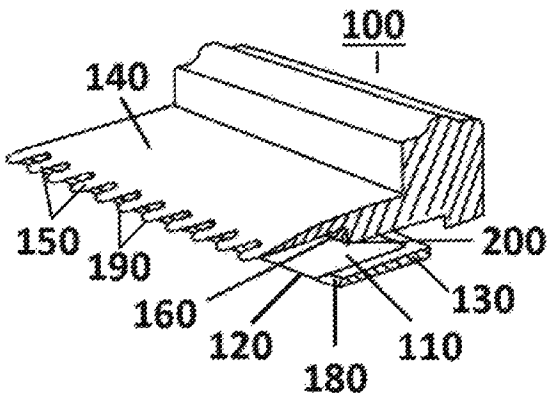
FIG. 9 is an elevated cut-away view of the apparatus as seen in FIG. 8 illustrating the comb, cutting blade and inner guard assembly according to embodiments of the present inventions.

FIG. 9 is an elevated cut-away view of the apparatus as seen in FIG. 8 illustrating the comb, cutting blade and inner guard assembly.

Figure 10:
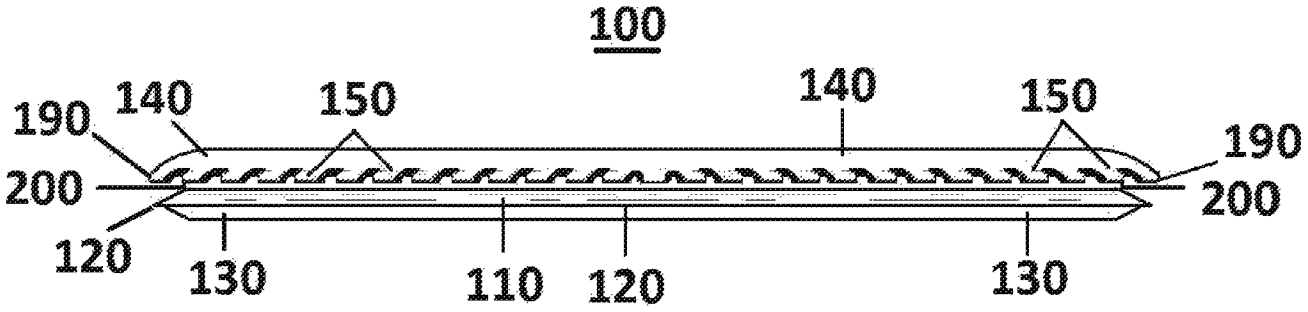
FIG. 10 is an eye-level view of the apparatus of the present inventions illustrating the comb, cutting blade and inner guard according to the first through fourth embodiments of the present inventions.

FIG. 10 is an eye-level view of the apparatus of the present inventions illustrating the comb, cutting blade and inner guard with like reference numerals according to any of the first through fourth embodiments of FIG. 1-7.

Figure 11:
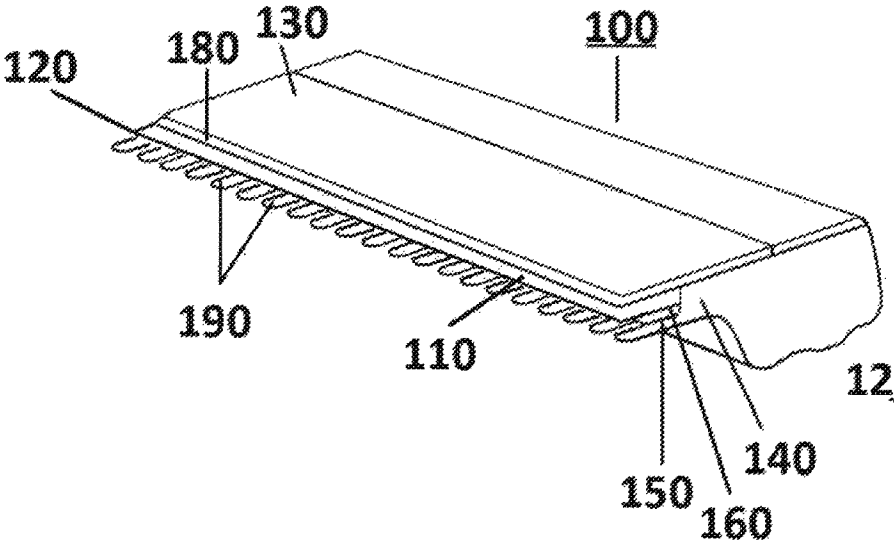
FIG. 11 is an elevated angled view of the present inventions whereby the inner guard is end up and apparatus is up-side down according to the first through fourth embodiments of the present inventions.

FIG. 11 is an elevated angled view of the present inventions whereby the inner guard 130 is end up and apparatus is up-side down with like reference numerals according to any of the first through fourth embodiments of FIGS. 1-7. As illustrated in FIG. 11 the safety razor 100 is in an upside-down position wherein the inner guard 130 is upright.

Figure 12:
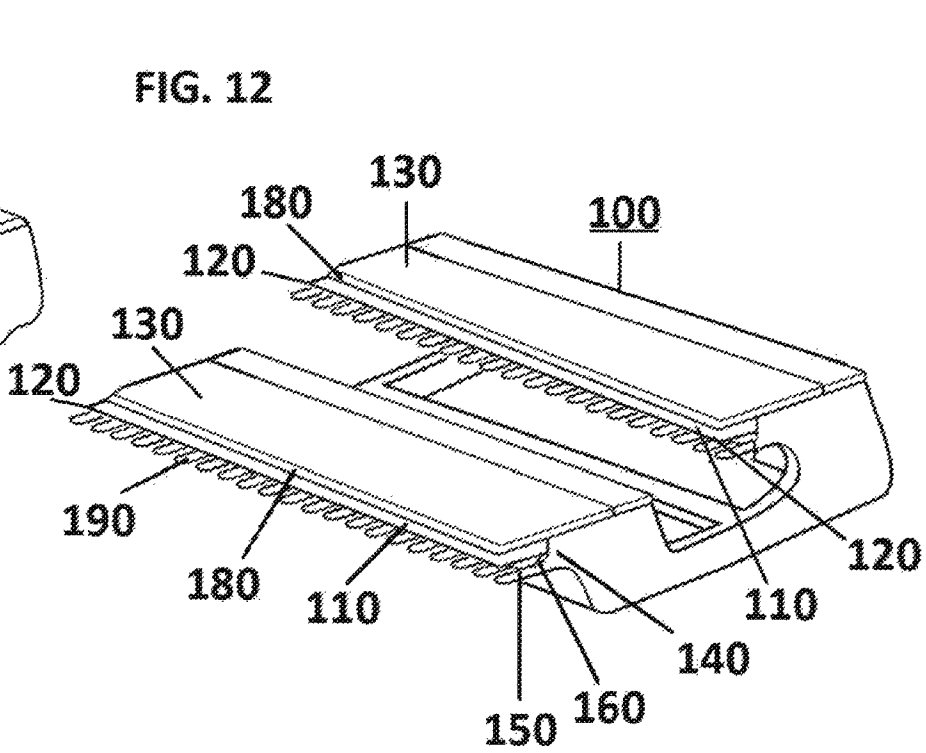
FIG. 12 is an elevated angled up-side down view of the present inventions that illustrates a plurality of razor blades assembled together as one apparatus according to the first through fourth embodiments of the present inventions.

FIG. 12 is an elevated angled up-side down view of the present inventions that illustrates a plurality of safety razors 100 assembled together as one apparatus with like reference numerals according to any of the first through seventh embodiments. As illustrated in FIG. 12 are redundant safety razors 100 creating a dual-blade structure.

Figure 13:
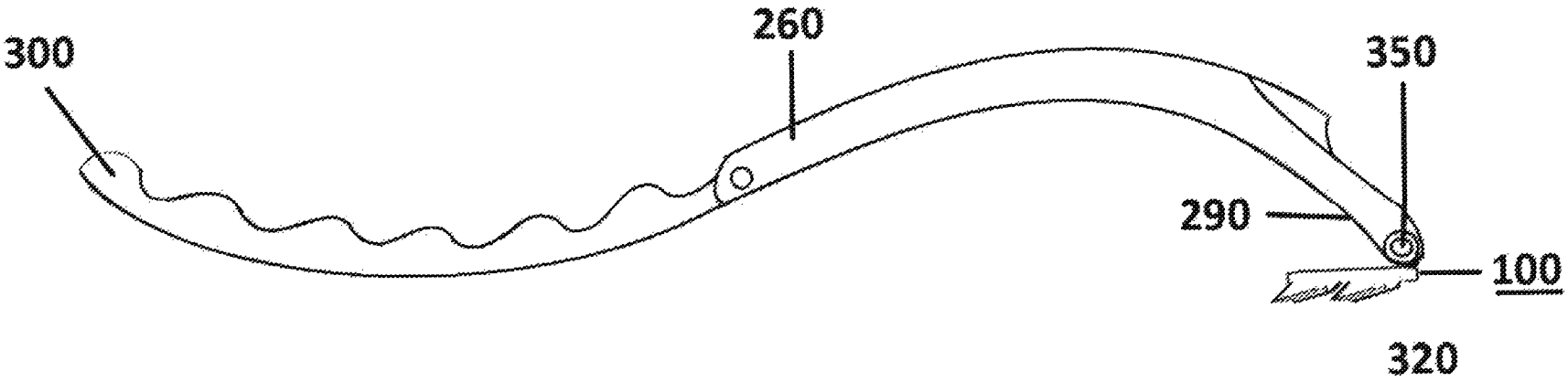
FIG. 13 is a side view the elongated handle by which the razor blade attaches on the upper end to in order to reach and shave areas of the body according to first through fourth embodiments of the present inventions.

FIG. 13 is a side view the elongated handle 260 by which the safety razor 100 attaches on the upper end 290 to in order to reach and shave areas of the body. As illustrated in FIG. 13 a safety razor 100 may attach to an elongated handle 260 which has an upper end 290 as well as a lower end 300 and a receiving end 320. Using the elongated handle 260 with attached safety razor 100 allows for access to desired shaving areas that may be hard-to-reach or prove difficult access. The elongated handle 260 has a straight distance measured directly from the upper end 290 to the lower end 300 that is measured not following the curve of the elongated handle 260 which is about 330 mm to about 457.2 mm A preferred straight distance of the back shaver handle 260 is about 355.6 mm.

Figure 14:
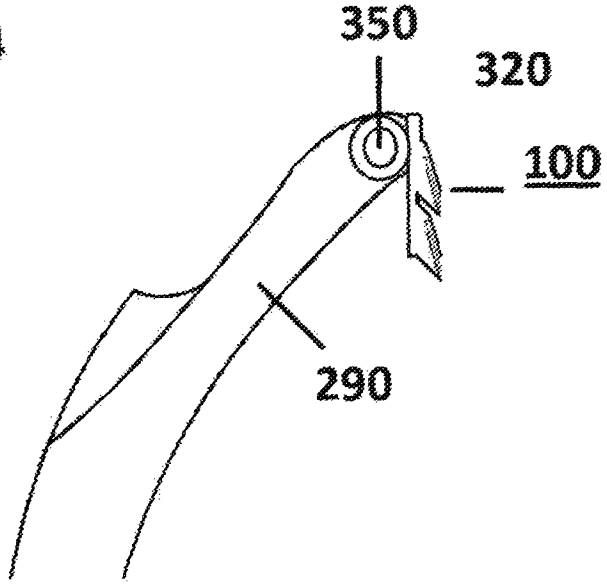
FIG. 14 is an side close up view of the end of the that handle whereby the razor blade attaches according to embodiments of the present inventions.

FIG. 14 is a side close up view of the upper end 290 of the handle whereby the safety razor 100 attaches. As seen from FIG. 14 upper end 290 or a portion thereof of receiving end 320 may be made from a material such as rubber or another flexible material that would allow the cutting blade 110 to pivot which would prove beneficial during the shaving process. A handle at the upper end 290 comprises a flexible coupling 350 coupled to the safety razor 100. Furthermore, a flexible coupling 350 proves beneficial when a user to have flexibility in their shaving stroke in order to navigate bumps or contour angles that can otherwise prove difficult.

Figure 15:
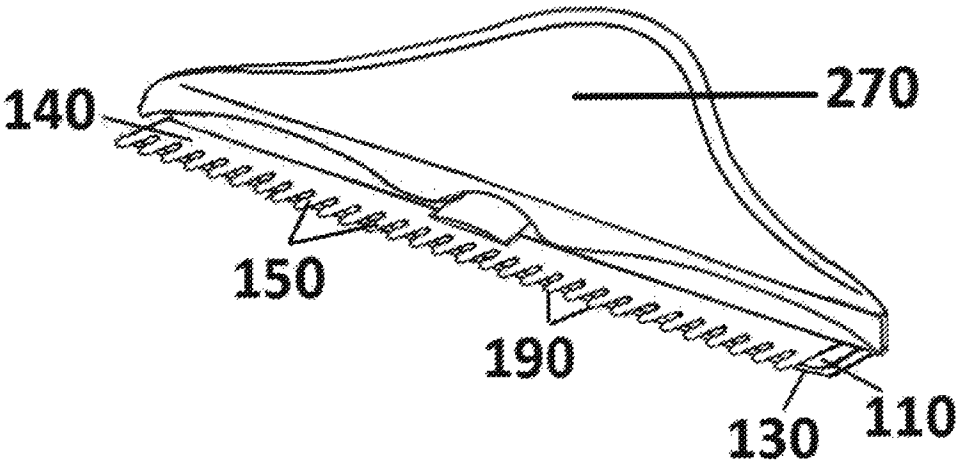
FIG. 15 is an elevated angled view illustrated a handle shaped to confirm to the shape of an individuals' hand or palm according to first through fourth embodiments of the present inventions.

FIG. 15 is an elevated angled view illustrated a palm-fitted handle 270 shaped to confirm to the shape of an individuals' hand or palm. As illustrated in FIG. 15 is a palm-fitted handle 270 used to accommodate desired shaving areas that would benefit from the safety razor 100 but would not necessarily require an elongated handle 260 in order to access the desired shaving area. One example of this embodiment would be for individuals who wish to shave hair on their arms or legs in order to better display their tattoos. Because a safety razor 100 that is wider would prove more beneficial to shaving quickly a palm-fitted handle 270 would be much more accommodating versus a traditional shaving handle found in most markets.

Figure 16:
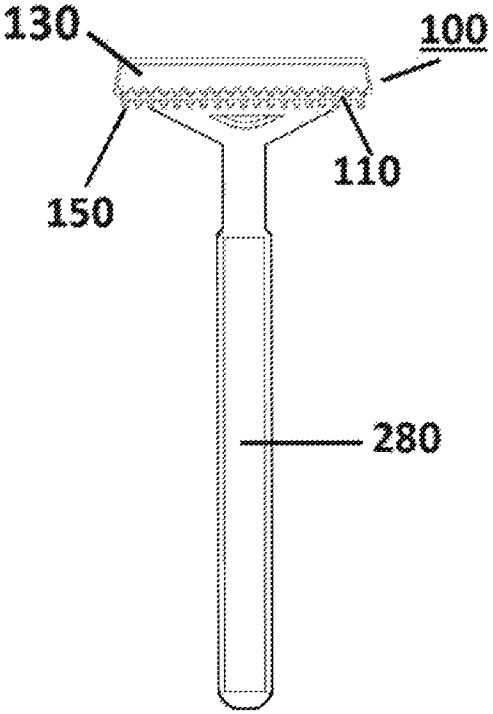
FIG. 16 is an elevated angled view of the present inventions whereby the safety razor is attached a handle according to first through fourth embodiments of the present inventions.

FIG. 16 is an elevated angled view of the present inventions whereby the safety razor 100 is attached to handle 280 most commonly used in with traditional shaving razor blades that are used to shave one's face. As illustrated in FIG. 16 is a safety razor 100 is attached to a traditional shaving handle 280 to allow access to areas whereby such handle 280 may prove useful such as one's neckline. The present invention illustrated in FIG. 1 creates such a soft friction between sharp edge 120 of cutting blade 110 and a skin surface which would not be the most desirable for accomplishing a clean close shave on one's face. FIG. 1 is most beneficial for areas of the body wherein hair may exist to be less dense in population as it strives to reduce the level at which hair is cut while still disallowing stubble. However, the closer the base 200 is positioned to the sharp edge 120 the more rigid the cutting blade 110 becomes and the easier the shaving operation becomes when attempting to shave areas consisting of more dense population of hair such as one's face.

Figure 17:
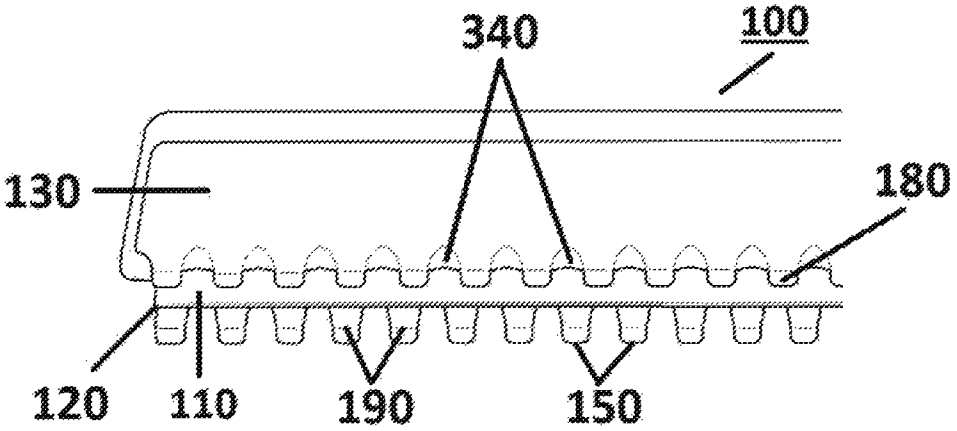
FIG. 17 is and front elevated view of the razor blade illustrating the web coverings existing between each tooth in order to conceal shorn hair from view according to the first through fourth embodiments of the present inventions.

FIG. 17 is and front elevated view of the razor blade illustrating the web covering 340 existing between each tooth in order to conceal shorn hair from view. The illustration of FIG. 17 can apply to any of the first through fourth embodiments of FIGS. 1-7. As previously mentioned and illustrated in FIG. 17 the inner guard 130 in a separate embodiment may embody a comb or teeth near the side wherein the inner guard edge 180 is positioned. That being said, the web covering 340 embodied in-between each tooth can be implemented between the teeth embodied within the elongated side of the inner guard 130 as well as the elongated side of the outer comb 140. The web covering 340 acts much like an umbrella overhang covering between each tooth in order to conceal any shorn hairs from the public viewing. Being that the current invention embodies a deep void 160 there poses a risk of shorn hairs getting clogged over time. Though most shorn hairs will past through the safety razor 100 there is a small percentage that may still get stuck or clogged within the deep void 160. Too often users of safety razors dispose far too quickly disposable razors that are esthetically unappealing due to a build-up of shorn hairs. The web covering 340 acts to conceal any unappealing shorn hairs that cannot get brushed out or unclogged.

Figure 18:
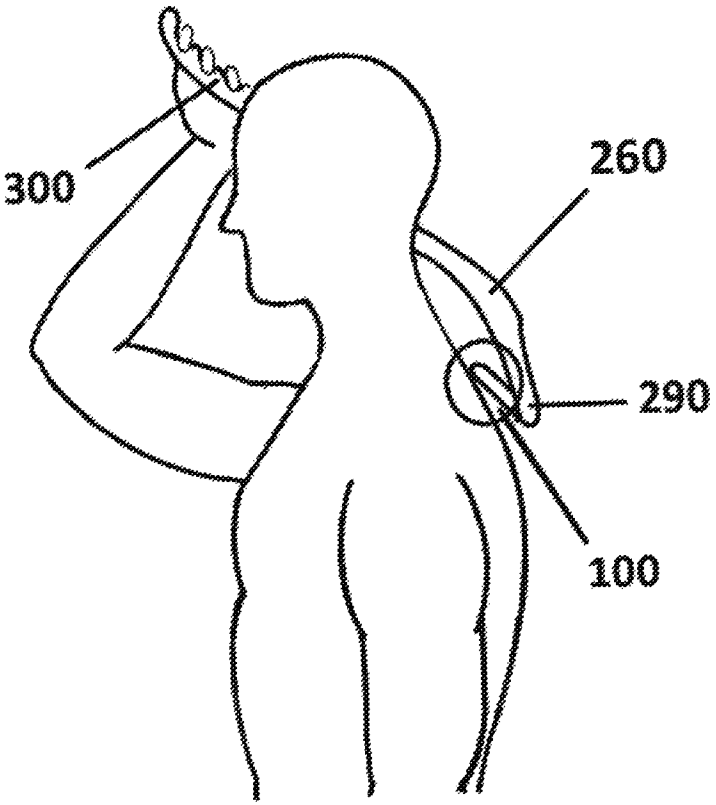
FIG. 18 is a view of an individual utilizing the safety razor by method of an elongated handle according to first embodiment of the present inventions.

FIG. 18 is a view of an individual utilizing the safety razor 100 by method of an elongated handle 260. As illustrated in FIG. 18 is an individual gripping the lower end 300 of the elongated handle 260 and utilizing the elongated handle 260 attached to a safety razor 100 and shaving the back side which often proves difficult in gaining appropriate access. Although the illustration of FIG. 18 illustrates the first embodiment of FIGS. 1-2, FIG. 18 can apply to any of the first through fourth embodiments of FIGS. 1-7. The elongated handle 260 has a straight distance measured directly from the upper end 290 to the lower end 300 that is measured not following the curve of the elongated handle 260 which is about 330 mm to about 457.2 mm A preferred straight distance of the back shaver handle 260 is about 355.6 mm.

FIG. 19 is a close up view of the safety razor 100 cutting hair along the back side of an individual. As illustrated in FIG. 19 is a close-up view of the safety razor 100 illustration of FIG. 18. Illustrated is the safety razor 100 shaving hair and cutting blade 110 flexing in a second position C according to the cutting action illustrated by FIG. 2 for the first embodiment. Furthermore, shorn hairs may pass through the outer teeth tips 150 and exit the safety razor 100 versus getting clogged or caught in the deep void 160. Though some hairs may get clogged or caught the web covering 340 covers visible exposure.

As previously indicated, FIG. 19 is a close-up view of the safety razor 100 as seen in FIG. 18 and illustrates the first embodiment illustrated in FIGS. 1-2. The skin surface contour has a convex skin surface contour between a pair of skin indents respectively created between both the outer comb 140 and the inner guard 130. When both the inside edge 190 of the outer comb 140 and the inner guard edge 180 of the inner guard 130 press into the skin, the recessed sharp edge 120 moves relatively closer towards the skin surface contour of the skin when cutting the hair.

The cutting blade 110 is at an angle nearly parallel to both the outer comb 140 and the inner guard 130 in embodiments. The cutting blade 110 of embodiments longitudinally bends in a direction of uncut hairs when the safety razor 100 is moved across the skin surface. The sharp edge of the cutting blade can longitudinally bend to cause further recess relative to the skin surface contour. This bend is in a direction less perpendicular to the skin surface. In embodiments of the present inventions, the cutting blade 110 in the safety razor 100 performs less rigidly against the skin surface and hair than in most prior razors. The deeper the void, the more the blade is cantilevered and the less rigid is its flexibility. Alternately, with a springier cutting blade 110 material or an inner spring, the blade has more flexibility. Such contributes to enhanced performance on dry conditions knowing that the closest save is not a highest priority on certain skin such as self-shaving the skin surface of ones back with a long handle 280 and no mirror.

A user of the safety razor 100 of embodiments can adjust how far the sharp edge 120 digs into the user's skin by varying the pressure of the safety razor 100 thereby adjusting how far the cutting blade 110 longitudinally bends. This may in some embodiments adjust the relative blade recess depth from the skin. These embodiments can be one mechanism for a user who feels adverse cutting feedback to adjust the blade recess by altering the pressure during the movement stroke. In other embodiments the cutting blade may be configured so altering speed or intensity of the movement stroke adjusts the blade recess.

Figure 20:
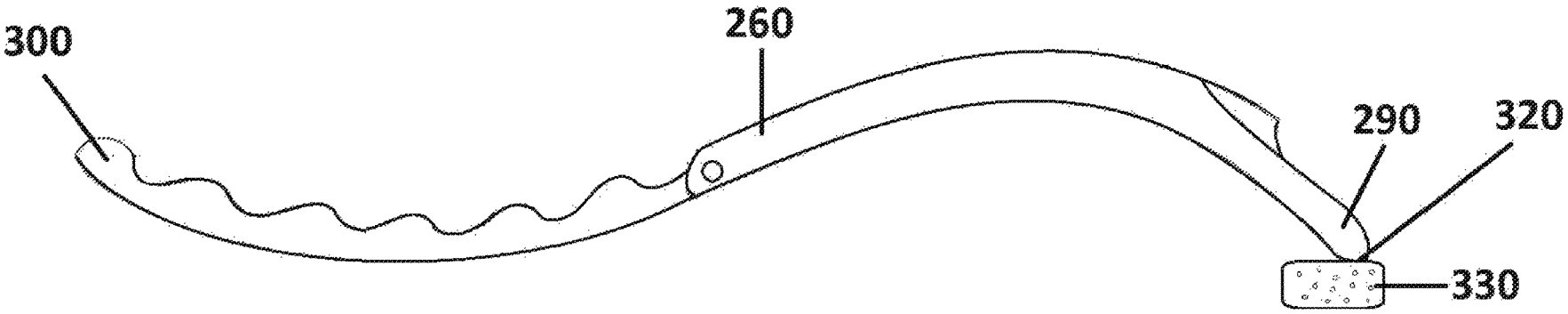
FIG. 20 illustrates a side view of a wet shave sponge with a handle according to embodiments of the present inventions.

FIG. 20 illustrates a side view of a safety razor 100 with an elongated handle 260 which embodies an upper end 290 and a lower end 300. As illustrated in FIG. 20 an elongated handle 260 can accept a shaving soap sponge 330 at a receiving end 320 near an upper end 290 opposite a lower end 300 and can easily be attached and removed in the same way the safety razor 100 can be easily attached and removed if an individual should decide to use the safety razor 100 in the shower which is commonly referred to as "wet shaving".

The term "flexible", as described previously in the first and second embodiment, is intended to describe the amount of bending or curved margin D the cutting blade 110 is granted in response to normal human opposing shaving forces. The "flexibility" of the cutting blade 110 in the first embodiment of FIGS. 1 and 2 is greater than the flexibility exhibited in the second embodiment or FIGS. 3 and 4. The term "flexible" takes on a different interpretation in the fourth embodiment wherein the flexible spring 170 is "flexed" allowing the cutting blade 110 to retract or flex horizontally and away from skin surface contour A.

A low friction between sharp edge 120 and a skin surface is illustrated in the first through the fourth embodiments illustrated in FIGS. 1-7 of the present inventions wherein a cutting blade 110 capable of less coarse hair found on an individual's back or arms at a depth allowing a smooth surface and all while minimizing cutting, razor burn as well as minimizing pulling or tugging hair while absent of an application of shaving cream or a shaving gel. Though a stronger friction may be allowed through the methods previously described, the preferred light or low friction is best practice when shaving one's back, buttock, arms or other areas that contain less dense areas of hair or areas that may be very sensitive to close shaving.

It is important to note in embodiments of the present inventions preferred cutting axis is a cutting axis between 20-50 degrees. An axis outside of 20-50 degrees, though may be accomplished, proves difficult when accessing petite skin surface areas whereby the risk of cutting or razor burn is greatly increased.

In further contrast to prior art the current invention does not require the razor blades to be exposed to water or shaving cream in order to offer a clean and close shave or to protect from cutting, nicking or skin irritation. This is a very important factor of the present inventions since application of shaving cream or lubricant can be extremely time consuming especially when applying to one's back side. Thus, not requiring the shaving cream lubricant is very time efficient. Furthermore, because the cutting blade 110 may be made from stainless steel the invention allows the safety razor 100 to last longer without any rusting since water and shaving cream, which will cause erosion or rust, is not necessary.

The preferred distance of separation between the inner guard edge 180 and the sharp edge 120 is a preferable margin of about 0.030 inches (about 0.0762 centimeter). The preferred distance of separation between the sharp edge 120 and the outer comb 140 inside edge 190 is about 0.032 inches (about 0.08128 centimeter). The preferred thickness of inner guard 130 is about 0.024 inches (about 0.06096 centimeter) or less. The preferred thickness of outer teeth tips 150 is about 0.026 inches (about 0.06604 centimeter) or less. The preferred cutting blade 110 exposure is about 0.030 inches (about 0.0762 centimeter) or less. Although the shaving geometry can be accomplished outside of these measurements these are preferred.

Although the invention is described herein with reference to specific embodiments, various modifications and changes can be made without departing from the scope of the present inventions as set forth in the claims below. Accordingly, the specification and figures are to be regarded in an illustrative rather than a restrictive sense, and all such modifications are intended to be included within the scope of the present inventions. They can have different configurations than the examples illustrated in the drawings. Any benefits, advantages, or solutions to problems that are described herein with regard to specific embodiments are not intended to be construed as a critical, required, or essential feature or element of any or all the claims.

Any letter designations such as (a) or (b) etc. used to label steps of any of the method claims herein are step headers applied for reading convenience and are not to be used in interpreting an order or process sequence of claimed method steps. Any method claims that recite a particular order or process sequence will do so using the words of their text, not the letter designations.

Unless stated otherwise, terms such as "first" and "second" are used to arbitrarily distinguish between the elements such terms describe. Thus, these terms are not necessarily intended to indicate temporal or other prioritization of such elements.

What is claimed is:

1. A safety razor for hair removal from skin, comprising:

a cutting blade having a planar surface and comprising a sharp edge;

an outer comb comprising a row of outer teeth running along the planar surface on an outside of the cutting blade, wherein the outer comb comprises a leading opening spaced between the row of the outer teeth and the planar surface of the cutting blade;

an inner guard comprising an inner guard edge running along the planar surface on an inside of the cutting blade, wherein a trailing opening is formed between the sharp edge of the cutting blade spaced from the inner guard edge of the inner guard; and a shaver handle coupled to the cutting blade, the outer comb, and the inner guard and having a longitudinal axis always substantially perpendicular to the sharp edge of the cutting blade, wherein the outer comb is between the shaver handle and the cutting blade; and wherein the cutting blade is held in a position between the outer comb and the inner guard.

2. A safety razor according to claim 1, wherein the leading opening is less than or equal to the trailing opening.

3. A safety razor according to claim 2, wherein the leading opening is less than or equal to the trailing opening when the cutting blade is recessed near a surface of the skin when pressing into the skin during shaving.

4. A safety razor according to claim 2, wherein the leading opening is less than or equal to the trailing opening when the cutting blade is recessed near a surface of the skin at rest.

5. A safety razor according to claim 1, wherein an exposure distance between an edge of the outer teeth and the inner guard edge of the inner guard is about 0.1727 centimeters (about 0.068 inches).

6. A safety razor according to claim 1, wherein the leading opening is about 0.08128 centimeters (about 0.032 inches).

7. A safety razor according to claim 1, wherein an inner distance BB measured along a longitudinal axis H of the cutting blade to a vertical plane of the inner guard edge of the inner guard in relation to an outer distance N measured along the longitudinal axis H of the cutting blade from edges of the outer teeth of the outer comb to the sharp edge of the cutting blade has a ratio of about 1.0.

8. A safety razor according to claim 7, the inner distance BB is between about 0.508 mm and about 1.016 mm.

9. A safety razor according to claim 8, wherein the inner distance BB is about 0.762 mm.

10. A safety razor according to claim 7, wherein the outer distance N is between about 0.508 mm and about 1.016 mm.

11. A safety razor according to claim 10, wherein the outer distance N is about 0.762 mm.

12. A safety razor according to claim 7, a flat plane defined by edges of the outer teeth of the outer comb and the inner guard edge of the inner guard, wherein a guard to guard distance along the flat plane from the inner guard edge of the inner guard to the edges of the outer teeth of the outer comb is between about 1.5 mm and about 2.54 mm.

13. A safety razor according to claim 12, wherein the guard to guard distance along the flat plane from the inner guard edge of the inner guard to the inside edge of the outer comb is about 2.3622 mm.

14. A safety razor according to claim 1, a flat plane defined by edges of the outer teeth of the outer comb and the inner guard edge of the inner guard, wherein an inner distance along the flat plane from the inner guard edge of the inner guard to a sharp edge of a cutting blade in relation to an outer distance along the flat plane from edges of the outer teeth of the outer comb to a sharp edge of a cutting blade has a ratio of about 1.74.

15. A safety razor according to claim 14, wherein the inner distance is between about 0.762 mm and about 1.6 mm.

16. A safety razor according to claim 15, wherein the inner distance is about 1.4986 mm.

17. A safety razor according to claim 14, wherein the outer distance along the flat plane from the edges of the outer teeth of the outer comb to the sharp edge of the cutting blade is between about 0.254 mm and about 0.889 mm.

18. A safety razor according to claim 17, wherein the outer distance along the flat plane from edges of the outer teeth of the outer comb to the sharp edge of the cutting blade is about 0.8636 mm.

19. A safety razor according to claim 1, wherein the inner guard comprises an inner comb to at least partially form the inner guard edge of the inner guard comprising a row of inner teeth running along the planar surface of the cutting blade.

20. A safety razor according to claim 1, further comprising another cutting blade having another planar surface and comprising another sharp edge;

another outer comb comprising another row of another outer teeth running along the another planar surface on another outside of the another cutting blade, wherein the another row of another outer teeth comprises other outer teeth edges;

another inner guard comprising another inner guard edge running along the another planar surface on another inside of the another cutting blade; and wherein the shaver handle is further coupled to the another cutting blade, the another outer comb, and the another inner guard and having its longitudinal axis always substantially perpendicular to the another sharp edge of the another cutting blade, wherein the another outer comb is between the body shaver handle and the another cutting blade; and wherein the another cutting blade is held in a position between the another outer comb and the another inner guard.

21. A safety razor according to claim 20, wherein the sharp edge of the cutting blade projects from the inner guard up to a flat plane defined by edges of the outer teeth of the outer comb and the inner guard edge of the inner guard; and wherein the another sharp edge of the another cutting blade projects from the another inner guard up to another flat plane defined by edges of the other outer teeth of the another outer comb and the another inner guard edge of the another inner guard.

22. A safety razor according to claim 1, wherein the cutting blade is a flexible cutting blade.

23. A safety razor according to claim 1, wherein the shaver handle is a short facial shaver handle.

24. A safety razor according to claim 1, wherein the sharp edge of the cutting blade projects from the inner guard up to a flat plane defined by edges of the outer teeth of the outer comb and the inner guard edge of the inner guard.

25. A safety razor according to claim 1, wherein the shaver handle is an elongated back shaver handle.

26. A method of using the safety razor of claim 25 for shaving hair on skin of a user, comprising the steps of:

(a) obtaining the safety razor;

(b) a hand of the user grasping the back shaver handle on a grip of the back shaver handle obtained in said step (a);

(c) the user reaching the back shaver handle over a shoulder of the user with the cutting blade facing towards a backside skin of the user;

(d) the user applying pressure against the backside skin of the user with the safety razor obtained in said step (a);

(e) the user making a movement stroke on the backside skin of the user with the safety razor obtained in said step (a); and (f) the user adjusting the cutting blade of the safety razor by altering the pressure of said step (d) during the movement stroke of said step (e).

27. A method of using a back shaver according to claim 26, wherein said step (f) of the user adjusting the cutting blade comprises the substep of (f)(1) adjusting how far the cutting blade bends towards the outer comb by varying the pressure of the safety razor.

28. A method of using a safety razor according to claim 26, wherein, in the safety razor obtained in said step (a), the planar surface on an outside of the cutting blade is parallel with and adjacent to a portion of the outer comb; and the planar surface on an inside of the cutting blade is parallel with and adjacent to a portion of the inner guard.

* * * * *